US007926933B2

(12) United States Patent
Taniuchi et al.

(10) Patent No.: US 7,926,933 B2
(45) Date of Patent: Apr. 19, 2011

(54) INK JET PRINTING METHOD AND INK JET PRINTING APPARATUS

(75) Inventors: Hiroshi Taniuchi, Yokohama (JP); Akihiro Mouri, Tokyo (JP); Katsumi Aoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1010 days.

(21) Appl. No.: 11/562,105

(22) Filed: Nov. 21, 2006

(65) Prior Publication Data

US 2007/0146462 A1 Jun. 28, 2007

(30) Foreign Application Priority Data

Dec. 27, 2005 (JP) ..... 2005-375949

(51) Int. Cl.
*B41J 2/01* (2006.01)

(52) U.S. Cl. ..... 347/103

(58) Field of Classification Search ..... 347/103
See application file for complete search history.

(56) References Cited

U.S. PATENT DOCUMENTS 6,109,746 A * 8/2000 Jeanmaire et al. ..... 347/103
2002/0175972 A1* 11/2002 Sanada ..... 347/47
2005/0110856 A1* 5/2005 Mouri et al. ..... 347/103
2005/0270351 A1 12/2005 Mouri et al.
2006/0152566 A1 7/2006 Taniuchi et al.
2006/0164488 A1 7/2006 Taniuchi et al.

FOREIGN PATENT DOCUMENTS

JP 10-315511 A 12/1998
JP 2004-042454 2/2004

* cited by examiner

*Primary Examiner* — Stephen D Meier
*Assistant Examiner* — Alexander C Witkowski
(74) *Attorney, Agent, or Firm* — Fitzpatrick, Cella, Harper & Scinto

(57) ABSTRACT

An ink jet printing method and an ink jet printing apparatus are provided in an embodiment of the present invention using an intermediate transfer body. With each of the apparatus and the method, it is possible to form a high-quality image in an ink jet printing system. In the embodiment of the invention, color ink and an auxiliary liquid are supplied to ink-attracting portions each having a certain area, the ink-attracting portions being surrounded by an ink-repellent portion. Subsequently, ink dots are transferred to a printing medium, the ink dots being formed by the supplied ink and the supplied liquid. Here, the ink-attracting regions have an area in which a plurality of droplets of the ink and the liquid in total can be received.

9 Claims, 12 Drawing Sheets

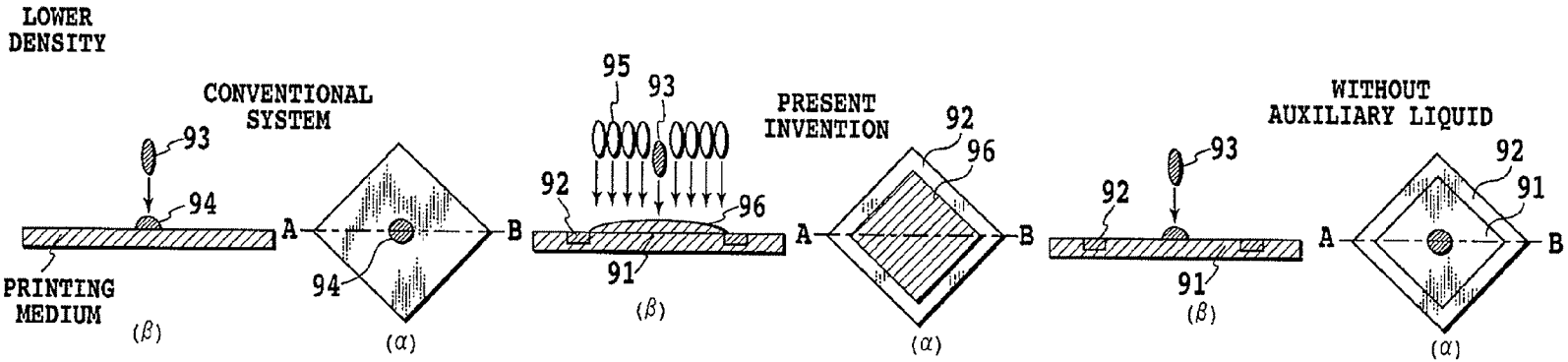
FIG.9A
FIG.9C
FIG.9E
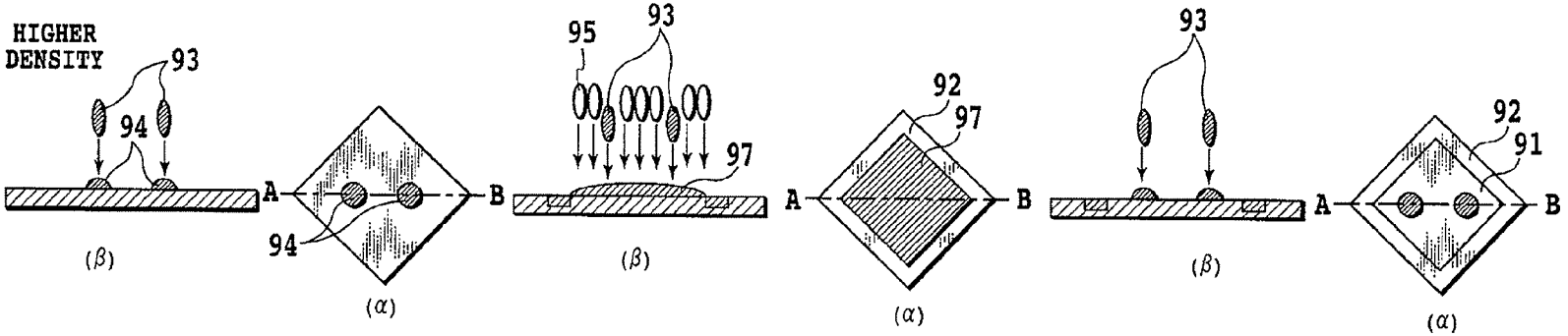
FIG.9B
FIG.9D
FIG.9F

INK JET PRINTING METHOD AND INK JET PRINTING APPARATUS

BACKGROUND OF THE INVENTION

1. Field of the Invention

The present invention relates to an ink jet printing method and an ink jet printing apparatus, more particularly relates to an ink jet printing method and an ink jet printing apparatus, in each of which an ink image is formed on a printing medium by use of an intermediate transfer body.

2. Description of the Related Art

There are the following two methods of reproducing gradations of a print.

1. Area gradation: method for pseudoreproducing gradations by difference of a size of coloring area per unit area with ink density same.

2. Density gradation: method for reproducing gradations by difference of ink densities with the size of coloring area per unit area same.

Ink jet printers, electrophotography, offset printing, flexographic printing, screen printing and the like can be taken as printing systems in which the area gradations are used. Meanwhile, photogravure printing can be taken as a printing system in which the density gradation is used.

The area gradation realizes excellent resolution, and is thus advantageously used to reproduce characters and lines. However, an area of a lower ink density, which is to be colored, has a smaller size. Accordingly, an amount of exposure of the surface of a printing medium in an image increases (a larger difference in density is caused between the image on the printing medium and an original). Accordingly, graininess becomes apparent.

From the above-described characteristics, the printing system, in which the density gradation is used, is preferable since a smooth gradation reproduction can be realized, especially in the case of outputting an image such as a photo. And in addition to photoprinting, in a case where output of a smooth and high-quality image is required, an image is printed preferably by use of the density gradations.

It is desirable that the density gradation be performed to obtain high-quality photo output, as described above. However, it is difficult to realize the density gradation with the current ink jet printing technique. The density gradation is not realistic even if lighter ink is used, since the number of ink types required in different densities correspond to the number of gradations requested. In order to reproduce 32 gradations of each of four colors CMYK, 124 types of ink (4×31=124) are necessary.

By the way, the ink jet printing method in which printing is carried out by use of the intermediate transfer body has been proposed as an ink jet printing technique. In the system in which the intermediate transfer body is used, it is important to accurately form an ink image on the surface of the intermediate transfer body, and to keep the ink image without causing distortion of the image until the ink image is transferred to a printing medium. Besides, in Japanese Patent Laid-Open No. 2004-42454, a sea portion (water-repellent portion) and island portions (hydrophilic portions) are formed on the surface of the intermediate transfer body for the purpose of keeping points in each of which ink lands. The sea portion has a larger contact angle with water of ink. Each of the island portions has a contact angle smaller than that of the sea portion. The ink having landed in the island portions, each of which has a contact angle smaller than that of the sea portion, does not spread to the sea portion, and is kept within the island portions. In other words, each of the ink droplets does not spread beyond the corresponding island portion because the island portions are surrounded by the sea portion having a contact angle larger than that of each of the island portions. Accordingly, image distortion can be reduced until the ink image is transferred from the intermediate transfer body to the printing medium, and thereby the ink image can be satisfactory transferred to the printing medium.

However, there still remain problems of the above-described gradation reproducibility even in such an ink jet printing method in which the intermediate transfer body is used. Improvement needs to be made to solve the problems. Specifically, the above-described density gradation is not realized in Japanese Patent Laid-Open No. 2004-42454. This is because gradations correspond to only two values respectively indicating that "ink exists" and that "no ink exists," although the sizes of the ink dots are regulated since the "island portions" are provided to the surface of the intermediate transfer body as portions to which the ink can be supplied.

SUMMARY OF THE INVENTION

An object of the present invention is to provide an ink jet printing method and an ink jet printing apparatus, with each of which it is possible to form a high-quality image in the ink jet printing system in which an intermediate transfer body is used.

In first aspect of the present invention, an ink jet printing method comprises the steps of: supplying ink and a transparent liquid to ink-attracting regions of an intermediate transfer body, the respective ink-attracting regions being surrounded by an ink-repellent region; and transferring an ink image to a printing medium, the ink image being formed by the supplied ink and the supplied liquid, wherein each of the plurality of the ink-attracting regions has an area in which a plurality of droplets of the ink and the liquid in total can be received.

In second aspect of the present invention, an ink jet printing method comprises the steps of: supplying ink and a liquid to ink-attracting regions of an intermediate transfer body, the respective ink-attracting regions being surrounded by an ink-repellent region, the liquid used for spreading the ink supplied to the ink-attracting regions over the entire regions of the corresponding ink-attracting regions; and transferring an ink image to a printing medium, the ink image being formed by the supplied ink and the supplied liquid, wherein each of the plurality of the ink-attracting regions has an area in which a plurality of droplets of the ink and the liquid in total can be received.

In third aspect of the present invention, an ink jet printing apparatus comprises: an intermediate transfer body including a plurality of ink-attracting regions, the respective ink-attracting regions being surrounded by an ink-repellent region; ink supply unit that supplies ink to the ink-attracting regions of the intermediate transfer body; liquid supply unit that supplies a transparent liquid to the ink-attracting regions of the intermediate transfer body; and a transfer unit that transfers an ink image to a printing medium, the ink image being formed by the supplied ink and the supplied transparent liquid, wherein each of the plurality of the ink-attracting regions has an area in which a plurality of droplets of the ink and the liquid in total can be received.

In fourth aspect of the present invention, an ink jet printing apparatus comprises: an intermediate transfer body including a plurality of ink-attracting regions, the respective ink-attracting regions being surrounded by an ink-repellent region; ink supply unit that supplies ink to the ink-attracting regions of the intermediate transfer body; liquid supply unit that supplies s a liquid to the ink-attracting regions of the intermediate transfer body, the liquid used for spreading the ink to be supplied to the ink-attracting regions over the entire regions of the ink-attracting regions; and a transfer unit that transfers an ink image to a printing medium, the ink image being formed by the supplied ink and the supplied liquid, wherein each of the plurality of the ink-attracting regions has an area in which a plurality of droplets of the ink and the liquid in total can be received.

In the present invention, ink and a liquid are supplied to an intermediate transfer body including ink-attracting regions, each of which is capable of receiving a plurality of droplets of the ink and the liquid in total. Accordingly, though the ink jet printing system is used, it is possible to realize the density gradation, and to form a high-quality image.

Further features of the present invention will become apparent from the following description of exemplary embodiments (with reference to the attached drawings).

BRIEF DESCRIPTION OF THE DRAWINGS

FIGS. 9A(α) to 9F(β) are views for explaining density gradations of an embodiment of the invention;

DESCRIPTION OF THE EMBODIMENTS

By referring to the attached drawings, favorable embodiments of the present invention will be described in detail below.

In an ink jet printing system of one of the embodiments of the invention, an intermediate transfer body has a surface on which an ink-repellent portion and ink-attracting portions are formed. Color ink, e.g. an auxiliary liquid such as a transparent ink, is supplied further to the intermediate transfer body to form a high-quality ink image on a printing medium.

In a case where inks used here are water-based, the ink-repellent portion is a water-repellent portion and each of the ink-attracting portions is a hydrophilic portion. Meanwhile, in a case where the used inks are oil-based, the ink-repellent portion is an oil-repellent portion and each of the ink-attracting portions is an oleophilic portion.

In the specification, the "ink-repellent portion" means a region where a contact angle with inks is larger than that of "ink-attracting portion". It is preferable that the contact angle in the "ink-repellent portion" is 60° or more.

In the specification, the "ink-attracting portion" means a region where the contact angle with inks is smaller than that of "ink-repellent portion". It is preferable that the contact angle in the "ink-attracting portion" is less than 60°. More preferably, the contact angle is 50° or less.

Figure 1:
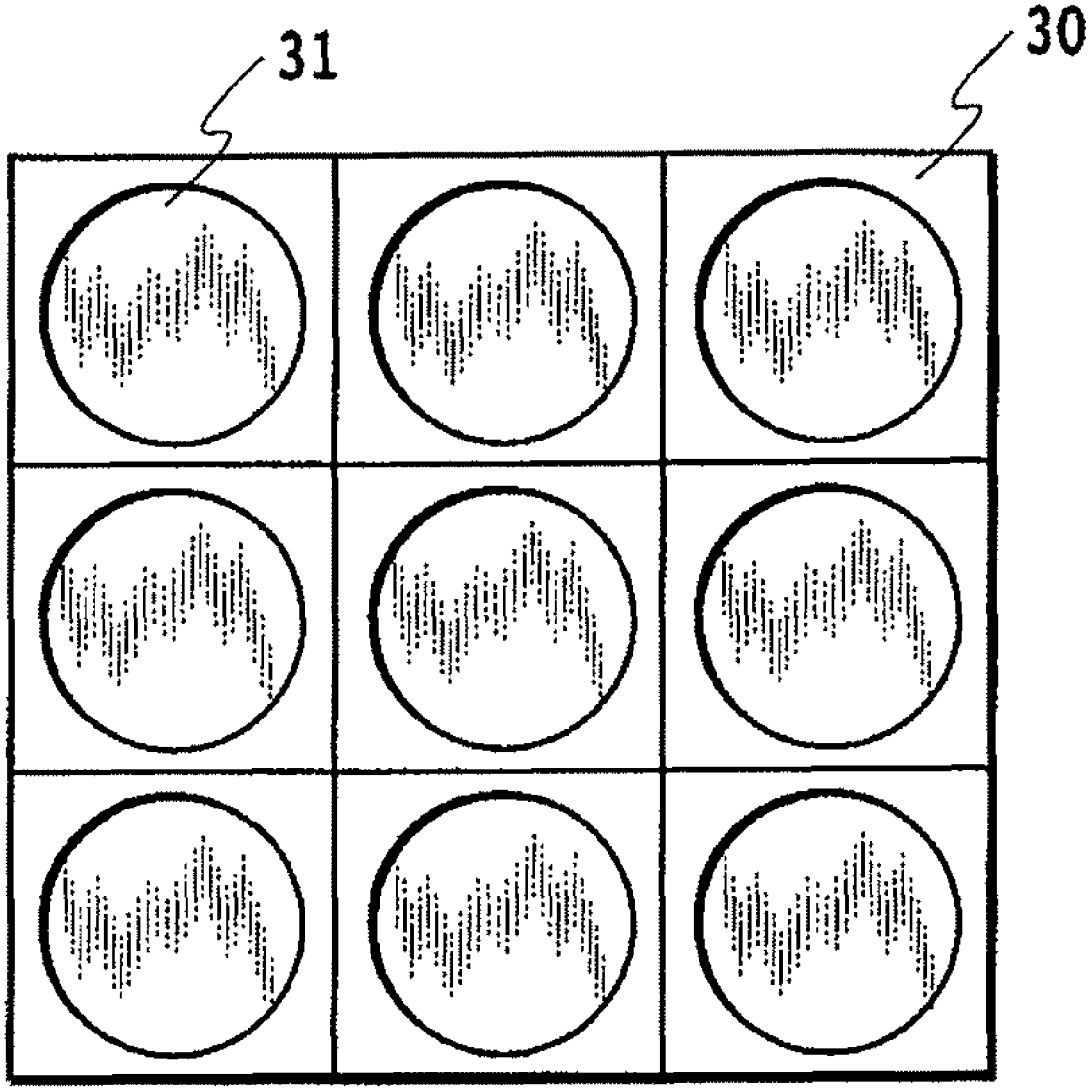
FIG. 1 is a view showing a pattern of ink-attracting portions and an ink-repellent portion which are formed on a surface of an intermediate transfer body of an embodiment of the present invention.

FIG. 1 shows an example of a shape pattern of an island-sea structure of a plurality of ink-attracting portions and the ink-repellent portion of the embodiment of the invention, the structure being formed on the surface of the intermediate transfer body. In the embodiment of the invention, as illustrated in FIG. 1, a plurality of ink-attracting portions 31 each of an island structure and an ink-repellent portion 30 of a sea structure are formed on the surface of the intermediate transfer body. Each of the ink-attracting portions 31 are surrounded by the ink-repellent portion 30. It is desirable that the basic center points of the respective ink-attracting portions 31 in each of the island structures be at the same intervals as, or an integral multiple of, those at which ejection ports of the printing heads are disposed. However, the basic centers are not limited to this.

In some cases, the inks ejected toward the corresponding ink-attracting portions 31 from printing heads are landed to overlap with the ink-repellent portion 30 because a direction, in which the printing head ejects the ink, fluctuates, for instance. Even in such a case, because of the ink-attracting portions 31 and the ink-repellent portion 30 formed as described, the droplets of the inks tend to move from the ink-repellent portion 30 to the ink-attracting portions 31. The ink droplets having moved can be kept in the ink-attracting portions 31, and are accurately positioned with accuracy.

One feature of the embodiment of the invention is that single ink-attracting portion 31 has an area in which a plurality of droplets in total of the color inks and the auxiliary liquid can be received. Note that only one ink droplet or a plurality of droplets may be supplied to each of the ink-attracting portions 31 to be formed as an image. Besides, the sum of the number of droplets of the color inks and the number of droplets of the auxiliary liquid (transparent ink) is not less than N (N is an integer larger than 1).

The auxiliary liquid in the embodiment is used for adjusting the densities of ink to be supplied to the ink-attracting portions. The auxiliary liquid used for the adjustment of the densities plays a role in spreading the color ink over the entirety of each of the pixels. Since the ink-attracting portions correspond respectively to the pixels, the numbers of droplets of the color ink which can be received by the ink-attracting portions correspond to the numbers of the corresponding gradations. Hence, in order to print an image with gradations equivalent to those of a photo, the ink-attracting portions 31, each with a size in which a substantial amount of ink droplets can be received, are necessary. The ink-attracting portions 31 each having such a size are relatively large. Accordingly, a case where a small amount as one or two droplets of color ink are supplied to an ink-attracting portion 31 leads to a case where the ink does not spread over the entirety of the ink-attracting portion 31. Taking this aspect into consideration in this embodiment, the auxiliary liquid is supplied to ink-attracting portions in addition to the color ink. Accordingly, it is made possible to spread the color ink over the ink-attracting portion 31 by increasing only the total amount of liquids to be supplied to an ink-attracting portion 31 while not changing the amount of the color ink.

As described above, the plurality of color ink droplets and the plurality of auxiliary liquid droplets supplied to the ink-attracting portion 31 are mixed after they land on the ink-attracting portion 31. If an amount of the droplets to be supplied thereto is proper, the droplets supplied to the ink-attracting portion 31 spread over the ink-attracting portion 31. Accordingly, if the area of the ink-attracting portion 31 is constantly set, it is possible to make the spread of the color ink landed to a constant area. Thus, the density gradation can be realized by controlling an amount of the auxiliary liquid such as transparent ink and an amount of the color ink supplied to each of the ink-attracting portions 31.

In addition, it is effective that the ink and the auxiliary liquid are caused to land in a plurality of positions of each of the ink-attracting portions (pixels). When a structure is adopted in which the ink and the auxiliary liquid are caused to land in various points in each of the pixels, the ink is easily spread over the ink-attracting portions with smaller amount of liquid to be supplied thereto.

Note that the intervals, at which the ink-attracting portions are formed (forming density), are appropriately set according to image forming conditions. For instance, the interval between the ink-attracting portions in a direction in which the intermediate transfer body rotates is determined depending on the rate at which the intermediate transfer body rotates, and on the frequencies at which the corresponding printing heads eject liquid droplets. In addition, the forming density of the ink-attracting portion 31 may be the same density as, or larger density than, printing density of the ink droplet ejected from the ink ejection portion. The higher the printing density of the ink droplet is, the faster a speed of forming the image is.

The shapes and the sizes of the ink-repellent portion 30 and each of the plurality of the ink-attracting portions 31 are not limited to the above described ones. Each of the shapes can be formed in a circle, an ellipse, a rhombus, a square or the like. The proportion of the ink-attracting portion in the surface of the intermediate transfer body is in a range from 30% to 90% in a case where a circle or ellipse is used, and is in a range from 50% to 90% in a case where a rhombus or square is used. In a case where the aperture ratio is smaller than 30%, the entire image cannot be covered with the ink and the maximum density cannot be obtained. Meanwhile, in a case where the aperture ratio is larger than 90%, inks supplied to adjacent ink-attracting portions may be mixed together when an ink image is transferred to a printing medium. Accordingly, a satisfactory image may not be formed. The pattern of the ink-repellent portions is not limited to the pattern shown in FIG. 1, and any pattern can be used as long as the ink-attracting portions are surrounded by the ink-repellent portion.

It is desirable that the ink-repellent portion and the ink-attracting portions are prepared so that the height of the ink-repellent portion and the height of each of the ink-attracting portions are not so different from one another. Forming the ink-repellent portion and the ink-attracting portions on the same plane is ideal. This brings about an effect that ink transferability and cleaning characteristics is improved. Meanwhile, this also causes the decrease in the amount of ink to be received and the increase in dot gain at a time of image transfer. However, these can be solved by adopting a reacting fluid and an ink image processing unit both of which will be described later. Moreover, for instance, a plurality of different intermediate transfer bodies may be used respectively for different colors as preferable countermeasures against the above-described problems.

Surface processing method such as printing, mask coating, and plasma processing are taken as a method of forming the island portions (ink-repellent portions) and the sea portion (ink-attracting portion) on the surface of the intermediate transfer body of the embodiment of the invention. The methods described above are merely examples, and do not limit the method of forming the intermediate transfer body of the embodiment of the invention. In a case where a regular pattern constituted of the ink-repellent portion and the ink-attracting portions is formed on the surface of the intermediate transfer body, it is possible to use any one of a method of forming the ink-repellent portion in an ink-attracting base member and a method of forming the ink-attracting portions in an ink-repellent base member.

Descriptions will be provided below for the method of forming an ink-repellent portion (water-repellent portion) and ink-attracting portions (hydrophilic portions) on the surface of an intermediate transfer body in a case where a water-based ink is used.

The following method can be taken to produce a water-repellent pattern on an intermediate transfer body 201 formed of a hydrophilic base member. Specifically, in the method, a water-repellent material 204 is supplied to the hydrophilic surface of the intermediate transfer body 201 by use of a printing plate 202 as illustrated in FIGS. 2A to 2E. FIGS. 2A to 2D are cross-sectional views, and FIG. 2E is a top view showing the surface of the intermediate transfer body.

Figure 2A:
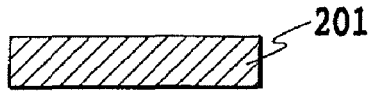
FIGS. 2A to 2E are views for explaining one method of forming an ink-repellent portion and ink-attracting portions on the surface of an intermediate transfer body of an embodiment of the invention.
Figure 2B:
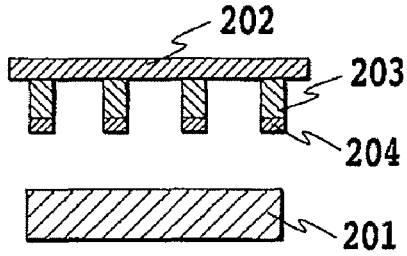
Figure 2C:
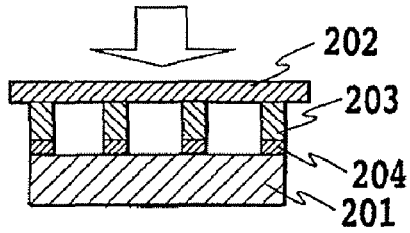
Figure 2D:
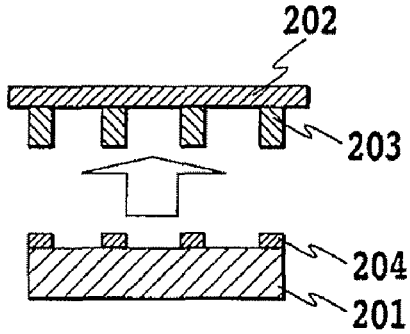
Figure 2E:
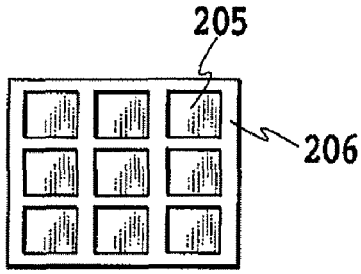

In the method, the intermediate transfer body 201 formed of the ink-attracting base member is prepared (FIG. 2A), and the printing plate 202 including jutting portions 203 in a pattern corresponding to a water-repellent portion is prepared (FIG. 2B). The water-repellent material 204 is applied to the surfaces of the jutting portions 203. The printing plate 202 is moved to make the water-repellent material 204 applied to the surfaces of the jutting portions 203, abut on the intermediate transfer body 201. Accordingly, the water-repellent material 204 moves from the jutting portions 203 to the intermediate transfer body 201. The water-repellent material 204 on the intermediate transfer body 201 serves as the water-repellent portion. Regions on the intermediate transfer body 201, in each of which water-repellent material 204 does not exist, serve as hydrophilic regions. Subsequently, the printing plate 202 is separated from the intermediate transfer body 201 (FIG. 2D). Accordingly, the regular pattern of the hydrophilic portions 205 and the water-repellent portion 206 is formed on the intermediate transfer body 201.

Figure 3A:
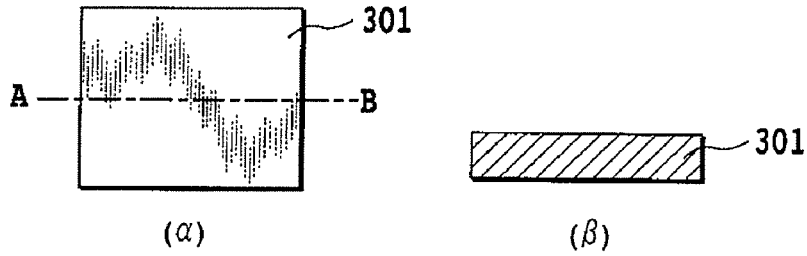
FIGS. 3A(α) to 3D(β) are views for explaining one method of forming an ink-repellent portion and ink-attracting portions on the surface of an intermediate transfer body of an embodiment of the invention.

Alternatively, the lift-off method can be taken to produce the pattern. In the lift-off method, as illustrated in FIGS. 3A(α) to 3D(β), a resist pattern 302 is formed by photolithography, thereafter, a water-repellent coating film 303 is supplied thereon as a water-repellent material, and then the resist pattern 302 is removed. In FIGS. 3A(α) to 3D(β), FIGS. 3A(α), 3B(α), 3C(α) and 3D(α) are top views of the intermediate transfer body, and FIGS. 3A(β), 3B(β), 3C(β) and 3D(β) are cross sectional views taken along the lines A-B respectively in the FIGS. 3A(α), 3B(α), 3C(α) and 3D(α).

In the lift-off method, the intermediate transfer body 301 formed of an ink-attracting base member is prepared (FIGS.

Figure 3B:
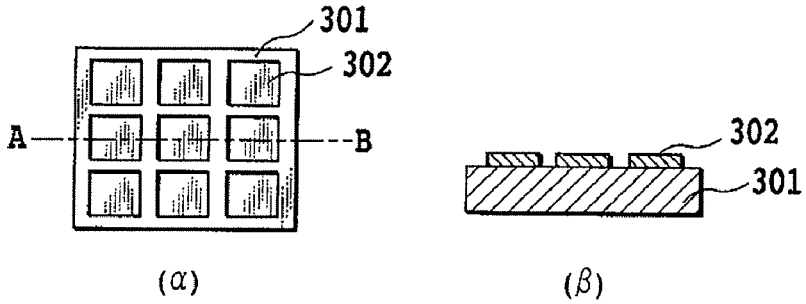
Figure 3C:
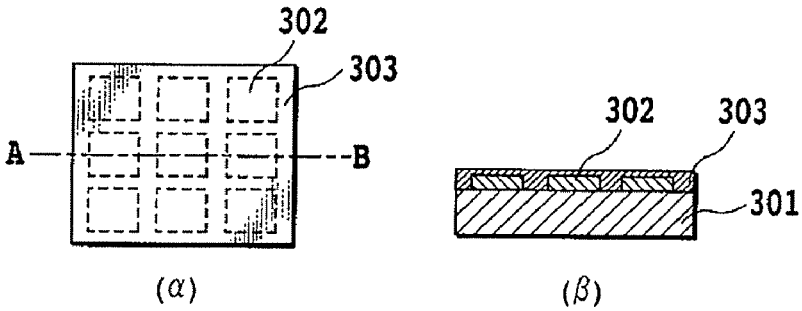
Figure 3D:
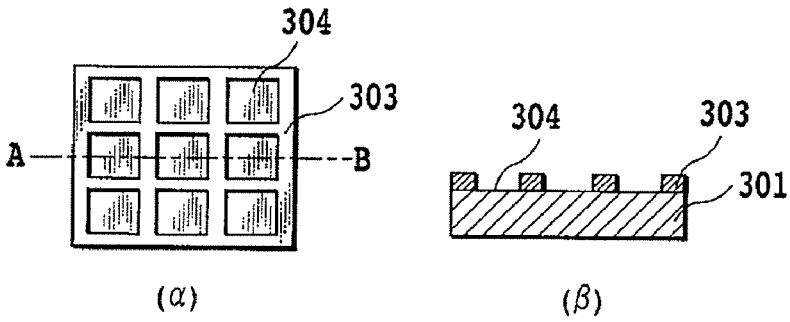

3A(α) and 3B(α)). Thereafter, the resist pattern 302 is formed on the surface of the intermediate transfer body 301 by the photolithography (FIGS. 3B(α) and 3B(β)). The resist portions serve as hydrophilic portions later. A water-repellent coating film 303 is formed on the intermediate transfer body 301 on which the resist pattern has been formed (FIGS. 3C(α) and 3C(β)), and then the resist pattern 302 is removed (FIGS. 3D(α) and 3D(β)). By removing the resist pattern 302 as described, the intermediate transfer body 302 having the hydrophilic surface is exposed from the removed portions. The exposed portions serve as hydrophilic portions 304. The water-repellent coating film 303 remaining on the intermediate transfer body 301 serves as the water-repellent portion. As a result, the pattern is produced.

Figure 4A:
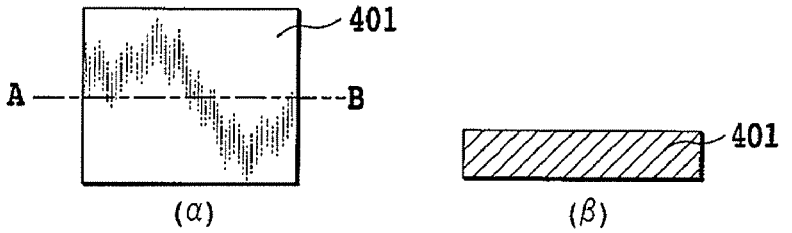
FIGS. 4A(α) to 4D(β) are views for explaining one method of forming an ink-repellent portion and ink-attracting portions on the surface of an intermediate transfer body of an embodiment of the invention.

Alternatively, a patterning method, in which a water-repellent resist illustrated in FIGS. 4A(α) to 4D(β) is used, can be taken to produce the pattern described above. In FIGS. 4A(α) to 4D(β), FIGS. 4A(α), 4B(α), 4C(α) and 4D(α) are top views of the intermediate transfer body, and FIGS. 4A(β), 4B(β), 4C(β) and 4D(β) are cross sectional views taken along the lines A-B respectively in the FIGS. 4A(α), 4B(α), 4C(α) and 4D(α).

Figure 4B:
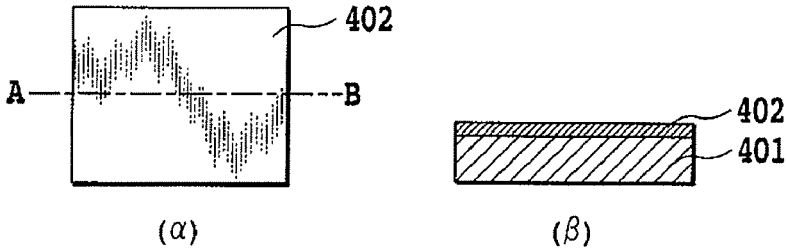
Figure 4C:
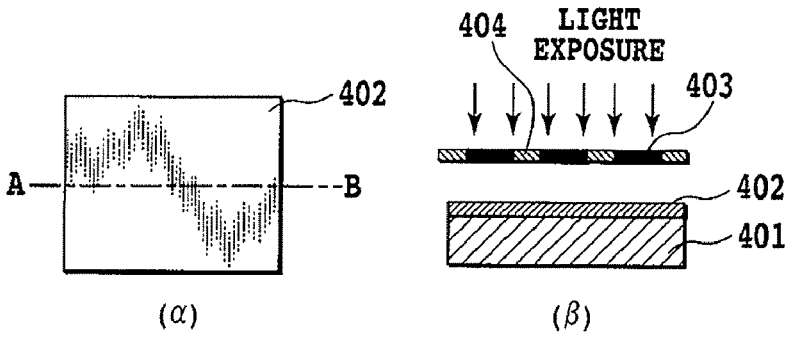
Figure 4D:
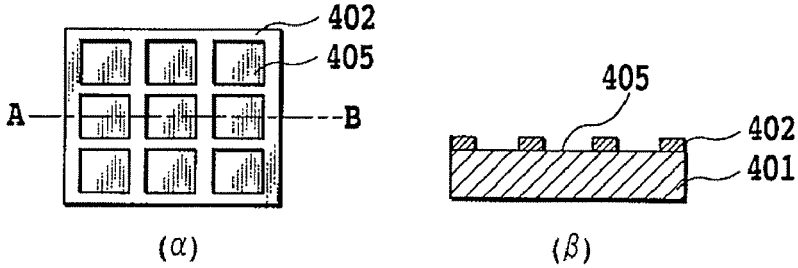

In the patterning method, an intermediate transfer body 401 formed of an ink-attracting base member is prepared (FIGS. 4A(α) and 4A(β)), and then a water-repellent resist 402 is applied to the surface of the intermediate transfer body 401 (FIGS. 4B(α) and 4B(β)). The water-repellent resist 402 is a photoresist into which an element such as fluorine atoms or compounds thereof showing water-repellent characteristics is mixed. A photomask 403 including a pattern corresponding to a water-repellent portion is used, and is exposed to light in order to transfer the pattern of the photomask 403 to the water-repellent photoresist 402 (FIGS. 4C(α) and 4C(β)). Subsequently, the water-repellent photoresist 402 to which the pattern 404 is transferred is developed to remove portions except the pattern 404 of the photoresist 402 (FIGS. 4D(α) and 4D(β)). The hydrophilic surface of the intermediate transfer body 401 is exposed from the removed portions, and the exposed regions serve as hydrophilic portions 405. The water-repellent resist 402 remaining on the intermediate transfer body 401 serves as a water-repellent portion. Accordingly, the pattern is produced.

Figure 5A:
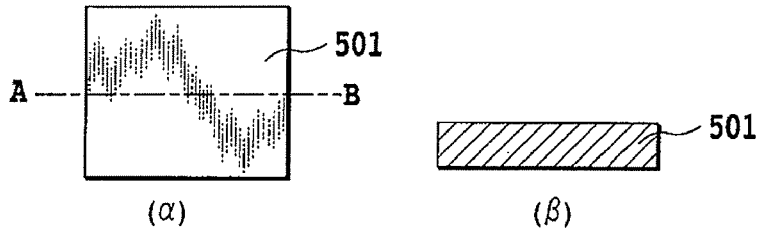
FIGS. 5A(α) to 5D(β) are views for explaining one method of forming an ink-repellent portion and ink-attracting portions on the surface of an intermediate transfer body of an embodiment of the invention.

Alternatively, the following method can be taken to produce the pattern described above. In the method, an element showing the water-repellent characteristics is caused to be introduced partially in an intermediate transfer body 501 by energy irradiation by use of a mask 502 as shown in FIGS. 5A(α) to 5D(β). Plasma irradiation or evaporation, in which a gas containing fluorine atoms is employed, can be taken as a specific energy irradiation method. In FIGS. 5A(α) to 5D(β), FIGS. 5A(α), 5B(α), 5C(α) and 5D(α) are top views of the intermediate transfer body, and FIGS. 5A(β), 5B(β), 5C(β) and 5D(β) are cross sectional views taken along the lines A-B respectively in the FIGS. 5A(α), 5B(α), 5C(α) and 5D(α).

Figure 5B:
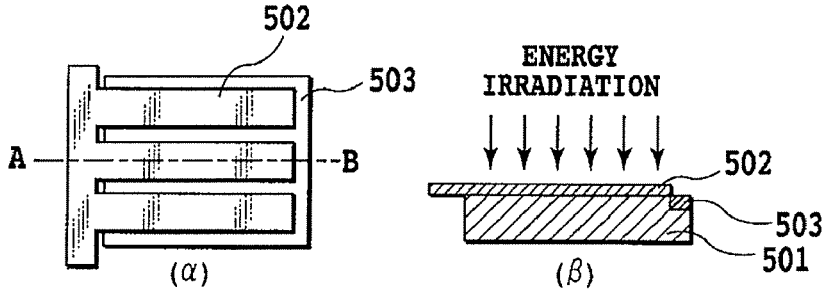
Figure 5C:
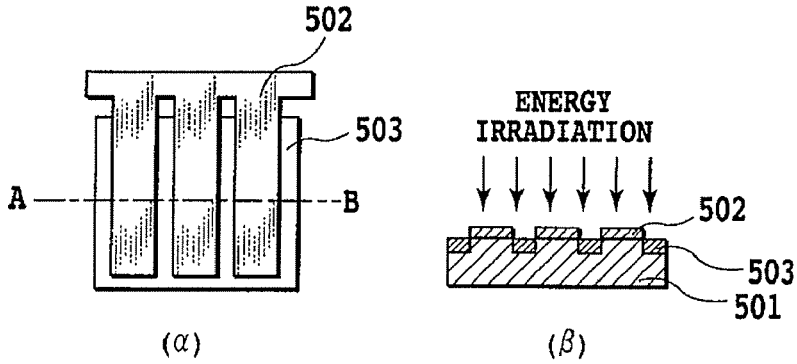
Figure 5D:
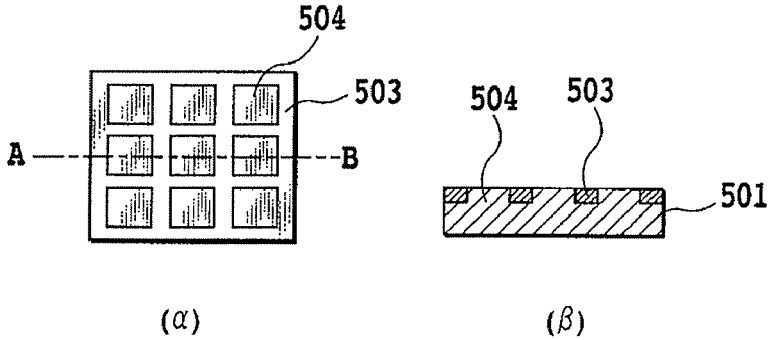

In the method, the intermediate transfer body 501 formed of an ink-attracting base is prepared (FIGS. 5A(α) and 5A(β)), and then plasma irradiation, in which a gas containing fluorine atoms is employed, is performed on the intermediate transfer body 501 by use of the mask 502 including a certain pattern (FIGS. 5B(α) and 5B(β)). Because of the plasma irradiation, a region of the surface of the intermediate transfer body 501, which is not masked, absorbs fluorine functioning as a gas showing the water-repellent characteristics, and thus serves as a water-repellent portion 503. Subsequently, the mask 502 is rotated by 90°, and then the plasma irradiation, in which the gas containing fluorine atoms is employed, is further performed on the intermediate transfer body 501 (FIGS. 5C(α) and 5C(β). Accordingly, regions not absorbing the fluorine gas because of the mask and a region absorbing the fluorine gas are formed on the intermediate transfer body 501 ((FIGS. 5D(α) and 5D(β)). The regions not absorbing the fluorine gas are hydrophilic, and thus serve as hydrophilic portions 504. Accordingly, the pattern is produced.

Figure 6A:
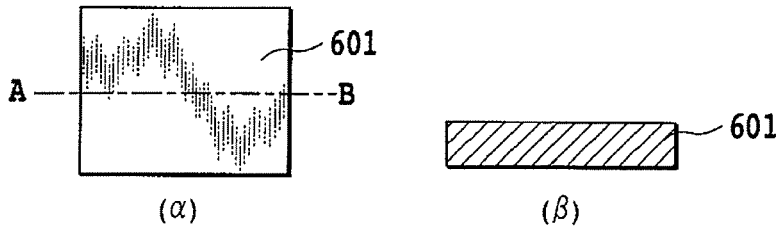
FIGS. 6A(α) to 6D(β) are views for explaining one method of forming an ink-repellent portion and ink-attracting portions on the surface of an intermediate transfer body of an embodiment of the invention.

Alternatively, the following method can be taken to produce the pattern described above. In the method, first, a water-repellent coating film 602 illustrated in FIGS. 6A(α) to 6D(β) is formed, and then hydrophilic portions 604 are exposed by partially processing the water-repellent coating film 602 by use of a laser. In a case where the water-repellent portion is formed of an organic resist, the water-repellent characteristics can be enhanced by plasma processing using the gas containing fluorine. In FIGS. 6A(α) to 6D(β), FIGS. 6A(α), 6B(α), 6C(α) and 6D(α) are top views of the intermediate transfer body, and FIGS. 6A(β), 6B(β), 6C(β) and 6D(β) are cross sectional views taken along the lines A-B respectively in the FIGS. 6A(α), 6B(α), 6C(α) and 6D(α).

Figure 6B:
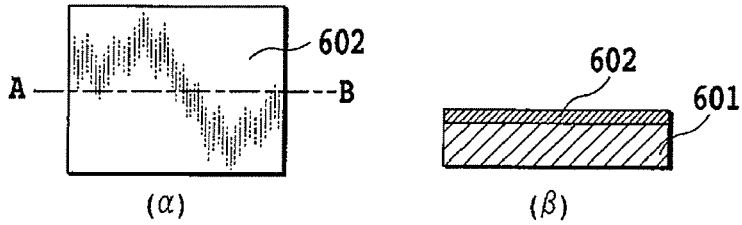
Figure 6C:
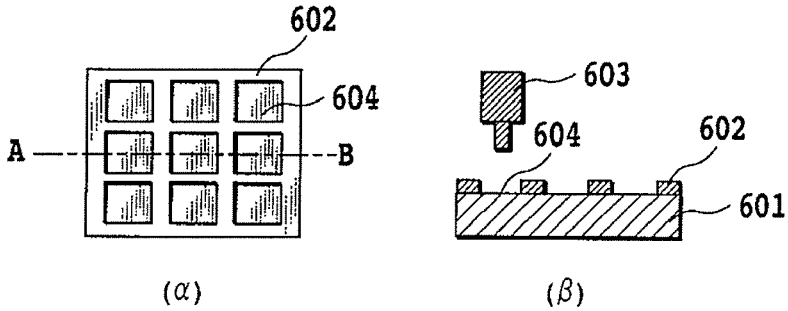
Figure 6D:
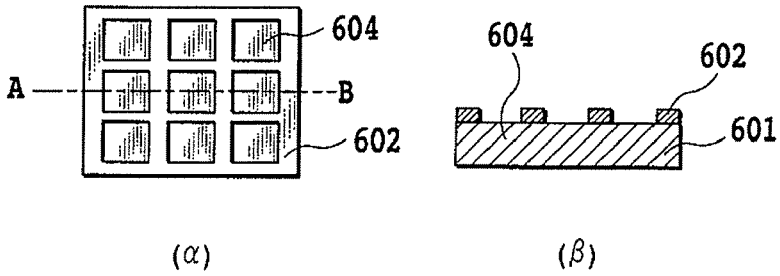

In the method, an intermediate transfer body 601 formed of an ink-attracting base member is prepared (FIGS. 6A(α) and 6A(β)), and then the water-repellent coating film 602 is applied to the surface of the intermediate transfer body 601 (FIGS. 6B(α) and 6B(β)). Subsequently, the water-repellent coating film 602 is irradiated with a laser by use of a laser irradiation apparatus 603. Accordingly, regions of the water-repellent coating film 602, which are irradiated with the laser, are removed. Hence, the hydrophilic surface of the intermediate transfer body 601 is exposed (FIGS. 6C(α) and 6C(β)). The exposed regions serve as hydrophilic portions 604, and the water-repellent coating film 602 remaining on the surface of the intermediate transfer body 601 serves as a water-repellent portion (FIGS. 6D(α) and 6D(β)). Accordingly, the pattern is produced.

In each of the above-described methods showed in FIGS. 2A to 6D(β), a water-repellent pattern is formed on the intermediate transfer body having the hydrophilic surface. However, examples taken below are of a method of forming a hydrophilic pattern in the surface of an intermediate transfer body formed of a water-repellent base. Silicone rubber, fluororubber, fluorosilicone rubber or the like is preferably used as the water-repellent base.

Figure 7A:
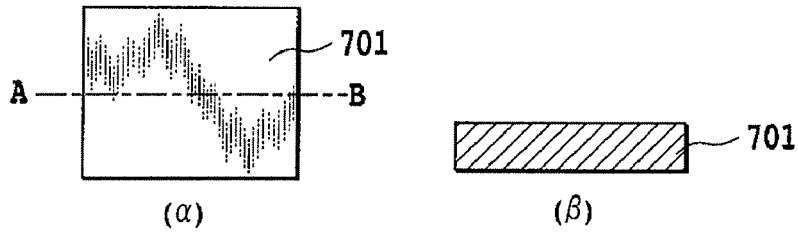
FIGS. 7A(α) to 7D(β) are views for explaining one method of forming an ink-repellent portion and ink-attracting portions on the surface of an intermediate transfer body of an embodiment of the invention.

For instance, the following method can be taken to form a water-repellent pattern in the surface of the intermediate transfer body 701 formed of the water-repellent base member. In the method, hydrophilic functional groups are introduced partially in the intermediate transfer body by energy irradiation in which a mask 702 is used as illustrated in FIGS. 7A(α) to 7D(β). Plasma irradiation or the like in which a gas containing oxygen atoms is employed can be taken as a specific energy irradiation method. In FIGS. 7A(α) to 7D(β), FIGS. 7A(α), 7B(α), 7C(α) and 7D(α) are top views of the intermediate transfer body, and FIGS. 7A(β), 7B(β), 7C(β) and 7D(β) are cross sectional views taken along the lines A-B respectively in the FIGS. 7A(α), 7B(α), 7C(α) and 7D(α).

Figure 7B:
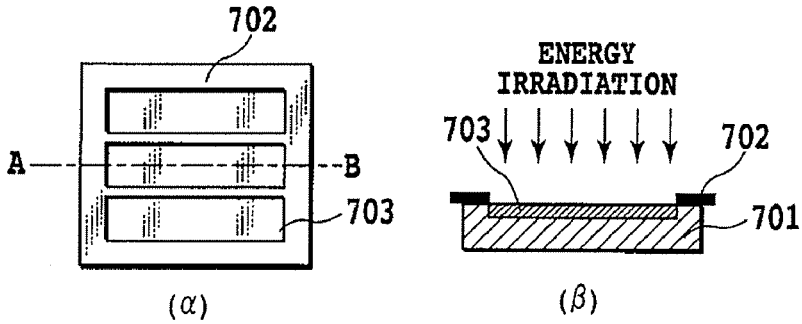
Figure 7C:
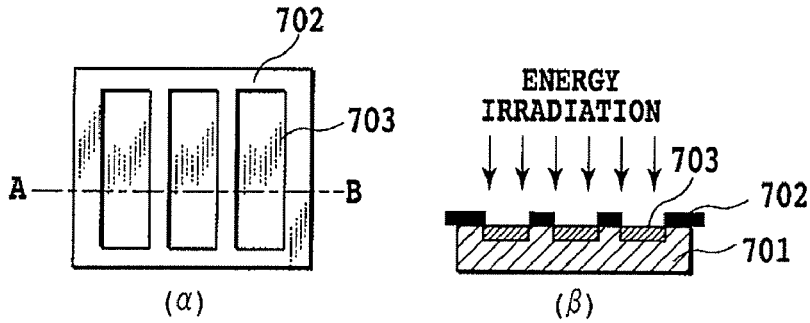
Figure 7D:
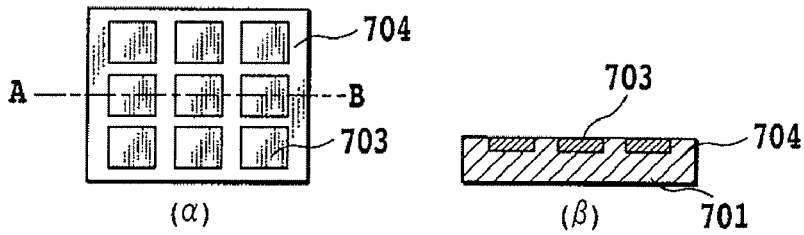

In the method, an intermediate transfer body 701 formed of an ink-repellent base member is prepared (FIGS. 7A(α) and 7A(β)), and then plasma irradiation, in which a gas containing oxygen atoms is employed, is performed on the intermediate transfer body 701 by use of the mask 702 including a certain pattern (FIGS. 7B(α) and 7B(β)). The plasma irradiation processes the surfaces of regions of the intermediate transfer body 701, which are not masked. The processed surfaces then serve as hydrophilic portions 703. Subsequently, the mask 702 is rotated by 90°, and then the plasma irradiation, in which the gas containing oxygen atoms is employed, is further performed on the intermediate transfer body 701 (FIGS. 7C(α) and 7C(β)). Accordingly, a region having the surface not processed because of the mask and the regions having respectively the surfaces processed (hydrophilic portions 703) are formed in the surface of the intermediate transfer body 701 ((FIGS. 7D(α) and 7D(β)). The region having the surface not processed is water-repellent, and thus serves as a water-repellent portion 704. Accordingly, the pattern is produced.

Figure 8A:
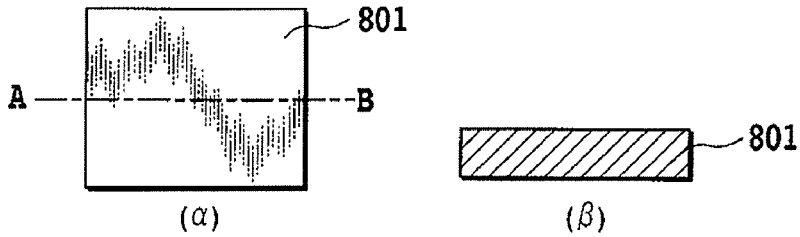
FIGS. 8A(α) to 8D(β) are views for explaining one method of forming an ink-repellent portion and ink-attracting portions on the surface of an intermediate transfer body of an embodiment of the invention.

Alternatively, the following method can be taken as illustrated in FIGS. 8A(α) to 8D(β) to form the pattern. In the method, a surfactant is supplied as a pattern after plasma irradiation. After a time has passed, hydrophilicity is lost in a portion excluding surfactant-supplied portions 805.

Figure 8B:
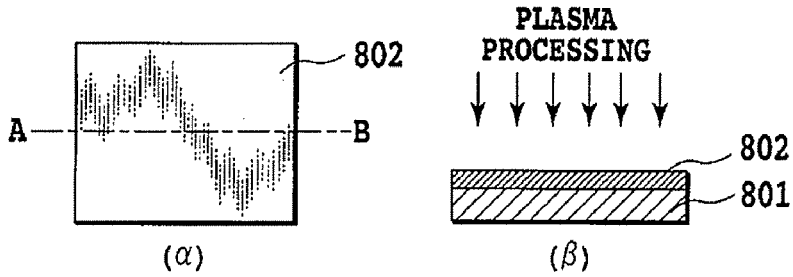
Figure 8C:
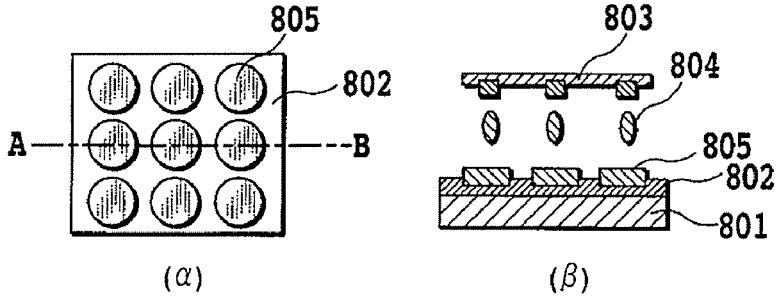
Figure 8D:
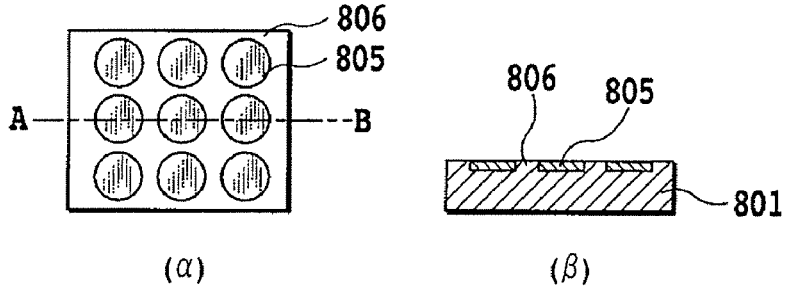

In the method, an intermediate transfer body 801 formed of an ink-repellent base member is prepared (FIGS. 8A(α) and 8A(β)), and then plasma processing is performed on the surface of the intermediate transfer body 801 to form a processed-surface portion 802 on the surface (FIGS. 8B(α) and 8B(β)). Subsequently, by use of a surfactant supplying apparatus 803, a surfactant 804 is applied to the surface of the processed-surface portion 802 as a pattern to form surfactant-supplied portions 805 on the processed-surface portion 802. After a time has passed, hydrophilicity is lost in the processed-surface portion 802 excluding the surfactant-supplied portions 805. Accordingly, a water-repellent portion 806 is formed. Meanwhile, the surfactant-supplied portions 805 keep the hydrophilicity, and thus serve as hydrophilic portions. Accordingly, the pattern is produced.

Furthermore, a method of supplying both of the hydrophilic portions and the water-repellent portion can be taken by combining the above-described methods. Alternatively, a method can be taken as well, in which an intermediate transfer body is partially made hydrophilic by mixing a material exhibiting hydrophilic characteristics under the irradiation of light, such as titanium oxide, into the intermediate transfer body, or by forming a film of the hydrophilic material on the surface of the intermediate transfer body, and then the film is irradiated with light.

First Embodiment

In a first embodiment, a color ink and an auxiliary liquid such as a transparent ink are mixed in each of regions (pixels) each having a constant area to regulate an ink density in the pixel. This method makes it possible to realize density gradations in the ink jet printing system.

In the embodiment, the size of each of the ink-attracting portions formed on the intermediate transfer body is made equal to the pixel size, and thus each of the ink-attracting portions has a certain size in order to achieve the density gradations. To have a large number of gradations, a plurality of droplets of the ink and the auxiliary liquid can land in each of the hydrophilic portions. With the area of each of the hydrophilic portions of the embodiment, a plurality of droplets of the ink and the auxiliary liquid can be received by the hydrophilic portions.

FIGS. 9A(α) to 9F(β) are views for showing differences between a conventional gradations reproduction and a gradations reproduction of the invention. FIGS. 9A(α) to 9B(β) are views for explaining for gradations reproduction (area gradations) by use of a conventional ink jet printing system. FIGS. 9C(α) to 9D(β) are views for explaining for gradations reproduction (density gradations) by use of an ink jet printing system of the embodiment which uses the auxiliary liquid. Further, 9E(α) to 9F(β) are views for explaining for a case where prints to the intermediate transfer body having the ink-repellent portions and the ink-attracting portions, which can be applied to the invention, are performed without using the auxiliary liquid. In FIGS. 9A(α) to 9F(β), FIGS. 9A(α), 9A(β), 9C(α), 9C(β), 9E(α), and 9E(β) indicate cases of lower density, and FIGS. 9B(α), 9B(β), 9D(α), 9D(β), 9F(α), and 9F(β) indicate cases of higher density. Further, In FIGS. 9A(α) to 9F(β), FIGS. 9A(α), 9B(α), 9C(α), 9D(α), 9E(α) and 9F(α) are top views of one of the ink-attracting portion (pixel), and 9A(β), 9B(β), 9C(β), 9D(β), 9E(β) and 9F(β) are cross sectional views of the ink-attracting portions taken along respectively with the lines A-B respectively in FIGS. 9A(α), 9B(α), 9C(α), 9D(α), 9E(α) and 9F(α).

As shown in FIGS. 9A (α) to 9B(β), gradations are conventionally changed depending on a size of the area of an ink dot or ink dots 94 of a color ink 93 supplied to the pixel on the printing medium. For instance, in order to realize a lower density, one droplet of the color ink 93 is applied to one pixel to form one ink dot 94 as shown in FIGS. 9A(α) and 9A(β). In order to realize a higher density, two droplets of the color ink 93 are supplied to one pixel to form two ink dots 94, as shown in FIGS. 9B(α) and 9B(β). As a result, the ink coloring area of FIGS. 9B(α) and 9B(β) becomes about twice size of that of FIGS. 9A(α) and 9A(β), and the density of FIGS. 9B(α) and 9B(β) also becomes about twice density of FIGS. 9A(α) and 9A(β) The gradations reproduction is realized by regulating the area of an ink dot or ink dots in each pixel which is constant area as described.

Meanwhile, as shown in FIGS. 9C(α) to 9D(β), the coloring densities are changed by supplying a color ink 93 and an auxiliary liquid 95 such as transparent ink to one ink-attracting portion 91, while the coloring areas are made to be same. For instance, in order to realize a lower density, one droplet of the color ink 93 and eight droplets of the auxiliary liquid 95 are applied to one pixel to form a mixed solution 96 as shown in FIGS. 9C(α) and 9C(β). In order to realize a higher density, on the other hand, two droplets of the color ink 93 and seven droplets of the auxiliary liquid 95 are applied to the pixel to form a mixed solution 97 as shown in FIGS. 9D(α) and 9D(β).

When an appropriate total amount of the color ink 93 and the auxiliary liquid 95 are supplied to one ink-attracting portion 91 serving as a pixel, the mixed solution of the color ink 93 and the auxiliary liquid 95 having landed on the ink-attracting portion spreads over the entire ink-attracting portion 91. Accordingly, the areas of mixed solutions respectively formed in ink-attracting portions 91 can be uniform. In addition, the density of each of the mixed solutions can be changed by increasing or decreasing the amount of the color ink 93 to be supplied. Hence, the density gradations can be realized. In the FIGS. 9C(α) to 9C(β), the mixed solution 97 has a density higher than that of the mixed solution 96, because the mixed liquid 96 contains one droplet of the color ink in a pixel of the uniform area and the mixed solution 97 contains two droplets of the color ink in a pixel of the same uniform area.

As shown in FIGS. 9E(α) to 9F(β), it is not possible to realize the density gradation without the auxiliary liquid even when the intermediate transfer body including the ink-repellent portion and the ink-attracting portions is used, the ink-repellent and the ink-attracting portions being applicable to the invention. Since each of the droplets of the color ink having landed on the ink-attracting portion 91 has a smaller volume as shown in FIG. 9E(α) to 9F(β), the droplet cannot spread over the entirety of the ink-attracting portion. As a result, only gradations same as those conventionally obtained are realized.

The liquid formed on each of the ink-attracting portions is not necessarily the mixed solution of the color ink 93 and the auxiliary liquid 95. In a case where realization of the gradation of the maximum density is required, only the color ink 93 may be supplied without the auxiliary liquid 95. In this case, the above-described mixed solution contains only the color ink droplets. Meanwhile, in a case where no color ink is supplied to a pixel, only the auxiliary liquid 95 may be supplied. In this case, the auxiliary liquid may not be supplied by generating an auxiliary-liquid-supplying signal (auxiliary-liquid-supplying data). With the signal, the auxiliary liquid is not supplied to a pixel to which no color ink is supplied.

In the embodiment, it is important to cause droplets (of only the color ink, of only the auxiliary liquid, of color inks of not less than two colors, of not less than two types of auxiliary liquids, or of the mixed solution of the color ink and the auxiliary liquid), which is to be formed in a pixel, to spread in the entire pixel. To spread the droplets, an appropriate number of droplets of the liquid are supplied to the pixel.

As described, in the embodiment, since the ink-attracting portions are surrounded by the ink-repellent portion, the color ink and the auxiliary liquid can spread in each of the pixels to the same extent. In this regard, the number of droplets of the color ink and the auxiliary liquid to be ejected to each of the pixels is regulated to realize the density gradations in the ink jet printing method.

In the embodiment, the auxiliary liquid plays a role in spreading the color ink over the entirety of each of the pixels (as a result, as playing a role in lowering the density of the color ink). Accordingly, even in the case of a smaller amount of the color ink, the coloring area is uniform in every pixel. Thereby, the same state where the ink is transferred can be realized in every pixel. This equalizes a force generated when the ink is transferred, with which the ink is separated from the intermediate transfer body. Hence, the transfer rate can be improved. In other words, the transfer rate can be improved by adding the auxiliary liquid.

Conventionally, the following problem is sometimes caused in a case where an ink image is formed on the intermediate transfer body and then is transferred to a printing medium through a step of drying the ink image. The problem is that the transfer of the image is unstable when the image is dried with drying conditions based on a portion to which a larger amount of ink is supplied. The instable transfer is caused by excessive drying of portions each of which includes a smaller amount of water since a smaller amount of the color ink is supplied thereto. Meanwhile, in the embodiment, a larger amount of the auxiliary liquid is supplied to a portion to which a smaller amount of color ink is supplied for the purpose of dealing with the above-described problem. This results in little difference in drying state between the portions, in each of which a smaller amount of the color ink is supplied, and the portions, in each of which a larger amount of the color ink is supplied. Accordingly, the stability of ink image transfer is improved as well. From the viewpoint of improving of the stability of ink image transfer, it is more preferable that a certain total amount of liquid (the color ink and the auxiliary liquid) be supplied to each of pixels to realize the equal drying states of the pixels to be uniform.

As described, it is necessary to regulate the color ink density per area unit to realize density gradations. For this purpose, it is necessary that an area, over which the color ink spreads be uniform in each of the pixels. This is very difficult in the conventional inkjet printing system, and was impossible to realize as a matter of practice. This is because the size of an area to be colored is equal to that of the area in which an ink dot spreads. As long as the same ink is used, the spread of the ink dot can be regulated only depending on the size of the ink droplet. In other words, it goes without saying that the coloring area is smaller since only a smaller amount of the color ink is supplied to a portion to be colored in a lower density. Accordingly, graininess is left which is characteristically appears in the area gradation.

In the embodiment, on the other hand, it is possible to spread the coloring area by supplying the auxiliary liquid, even in the portion to be colored in the lower density (a portion where the amount of color ink is small). However, only using the auxiliary liquid, it is difficult to regulate the spread of the mixed solution to the pixel size accurately and stably. To deal with the difficulty, the size of each of the ink-attracting portions is made equal to that of a pixel, and the ink-attracting portions are surrounded by the ink-repellent portion in the embodiment. Since the ink-attracting portions are surrounded by the ink-repellent portion as described, the mixed solution including the ink and the auxiliary liquid does not spread beyond the size of each of the pixels. In the embodiment, the island-sea structure of the ink-attracting portions and the ink-repellent portion has a function of regulating the spread of the color ink, the auxiliary liquid and the mixed solution to the pixel size, to realize the density gradations.

In this way, it is possible to form a high-quality image by using the intermediate transfer body including the above-described sea-island structure on the surface thereof and the auxiliary liquid. In the embodiment, it is made possible to realize the density gradations because of the ink jet printing method. Furthermore, cost reduction can be brought about, since the density gradations can be realized without an expensive photogravure printing plate not as in the case of the conventional method.

Figure 10:
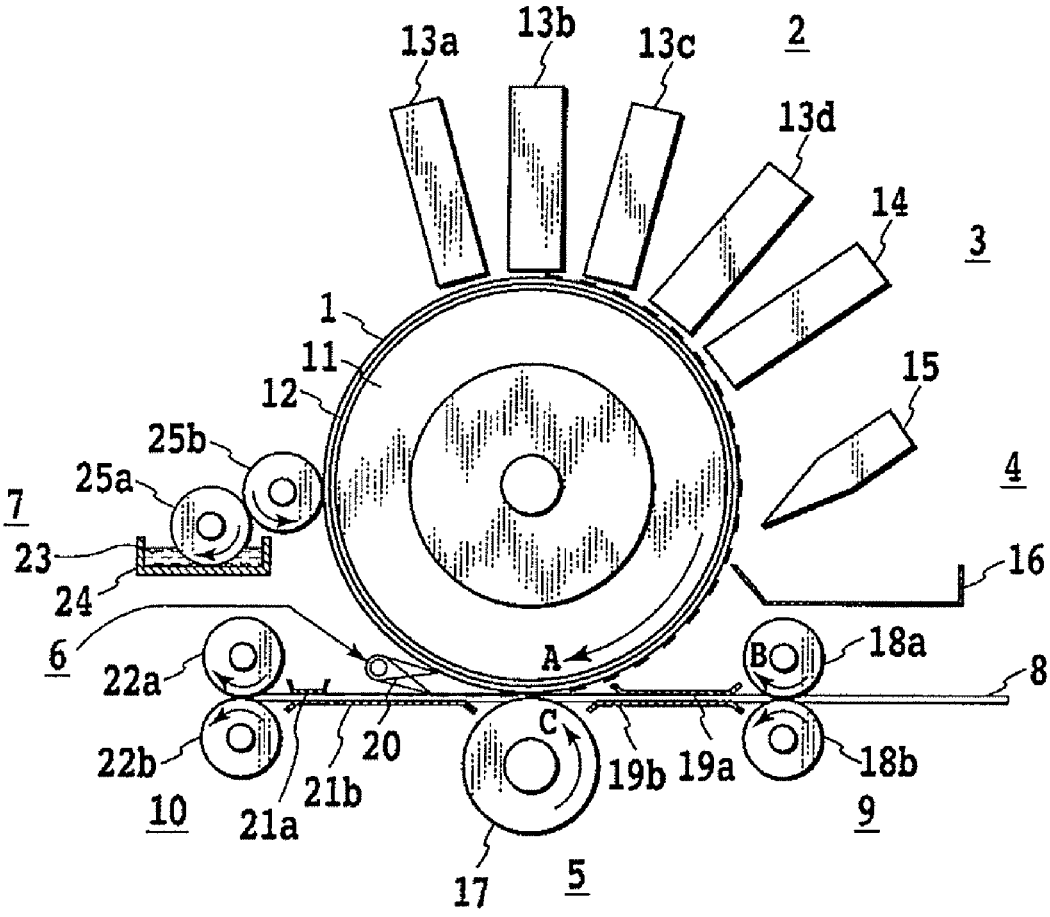
FIG. 10 is a schematic side view showing an ink jet printing apparatus of an embodiment of the invention.

FIG. 10 is a schematic cross-sectional view showing a structure of an image forming unit of the ink-jet printing apparatus of the embodiment. In FIG. 10, a transfer drum 1 is an intermediate transfer body including a surface layer having ink releasing characteristics. The transfer drum 1 is supported by an unillustrated shaft, and is rotationally driven by an unillustrated drum driving device in the direction shown by the arrow A in FIG. 10. An ink supplying unit 2, and an auxiliary-liquid-supplying unit 3, an ink image processing unit 4, a transfer unit 5, a printing-medium-separating unit 6, and a cleaning unit 7 are disposed in an order from the upstream side to the downstream side in the circumferential direction in which the transfer drum 1 rotates. A fed-sheet transfer unit 9 is disposed at the upstream side of a nip portion between the transfer drum 1 and a transfer roller 17. The fed-sheet transfer unit 9 transfers a printing medium 8 from an unillustrated printing medium storage unit (sheet cassette) to the nip portion. At the downstream side of the nip portion, a discharged-sheet-transferring fixing unit 10 is disposed. The discharged-sheet-transferring fixing unit 10 includes a fixing mechanism for fixing an ink image on the printing medium 8 after the ink image is transferred from the transfer drum 1 to the printing medium 8. In addition, the discharged-sheet-transferring fixing unit 10 discharges the printing medium 8 to a discharge tray. The ink jet printing apparatus includes an unillustrated control unit as well.

Detailed descriptions will be provided below for structures of the units described above.

Figure 11:
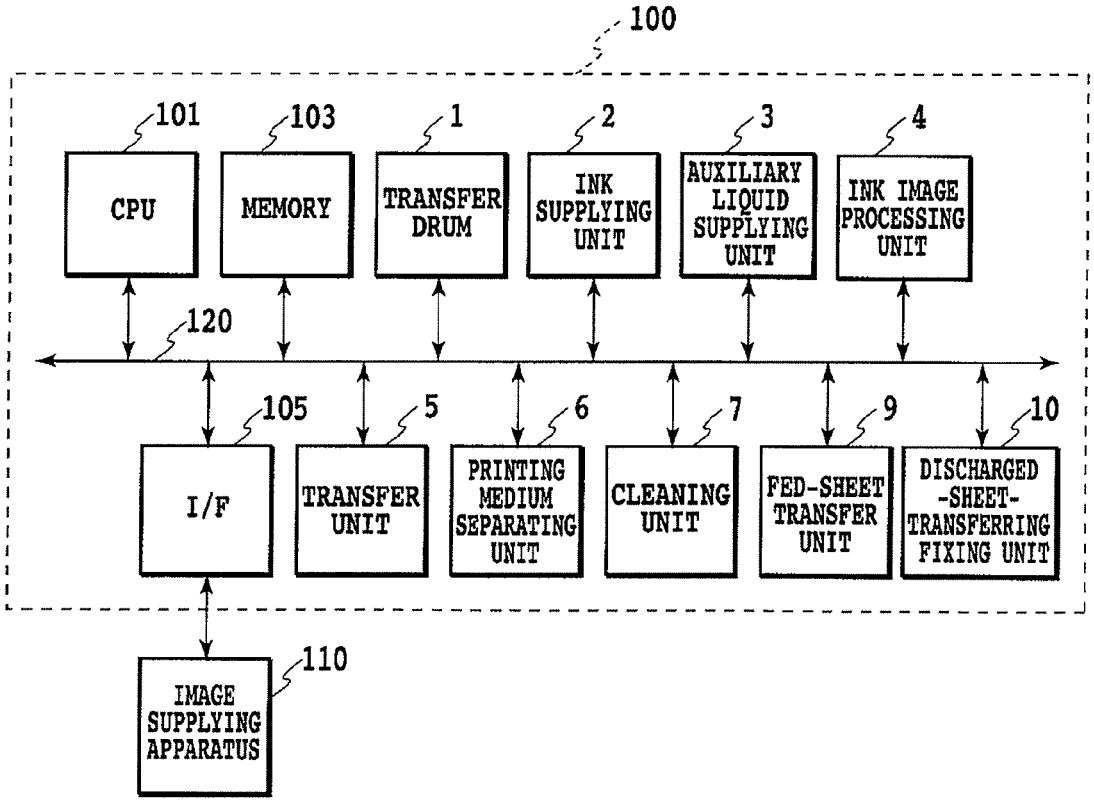
FIG. 11 is a schematic block diagram showing a structure of a control section of an embodiment of the invention.

FIG. 11 is a schematic block diagram showing the configuration of the control unit of the embodiment. In FIG. 11, a CPU 101 of the ink jet printing apparatus denoted as a whole by reference numeral 100 executes control processing and data processing, or the like, for operations of the ink jet printing apparatus. A memory 103 is a printing unit including an unillustrated ROM and unillustrated RAM. The ROM stores a program of a procedure of the above-described processings or the like. The RAM is used as a work area, or the like, to execute such processings. An I/F 105 realizes reception and transmission of information such as data or a command between the inkjet printing apparatus and an image supplying apparatus 110, such as a host computer, which is a supply source of image data.

In addition to the above units, the transfer drum 1, the ink supplying unit 2, the auxiliary-liquid-supplying unit 3, the ink image processing unit 4, the transfer unit 5, the printing-medium-separating unit 6, the cleaning unit 7, the fed-sheet transfer unit 9 and the discharged-sheet-transferring fixing unit 10 are connected to a bus line 120. Accordingly, the CPU 101 can receive and transmit a signal from or to each of the units via the bus line 120. State-detecting sensors are disposed respectively in the units to be controlled, and detection signals of the state-detecting sensors can be transmitted to the CPU 101 via the bus line 120.

(Intermediate Transfer Body)

In the embodiment, the intermediate transfer body may have in any of, for instance, a drum-like, belt-like, and roller-like shapes, as long as the surface thereof includes the sea-island structure of the ink-repellent portion and the ink-attracting portions. As methods of forming the island-sea structure, methods described in FIGS. 2A to 8D can be applied. In the transfer drum 1 serving as the intermediate transfer body, as illustrated in FIG. 10, layers are stacked on the outer periphery of a supporting member 11 made of aluminum. The layers include a surface layer 12 having the sea-island structure shown in FIG. 1. In a case where the intermediate transfer body of the embodiment has the drum-like shape, the intermediate transfer body can be formed by coating, or attaching a sheet to, a metal cylinder made of aluminum, SUS or the like. Resin, rubber, an inorganic material, or the like, may be used for the coating. The sheet may be made of resin, rubber or the like. A resin material includes nylon resin, polyester resin, polycarbonate resin, polyphenylene oxide resin, polyimide resin, polyetherimide resin, polyethersulfone resin, urethane resin, silicone resin, epoxy resin, fluororesin resin, or the like. A rubber material includes a natural rubber, butadiene rubber, styrene butadiene rubber, urethane rubber, chloroprene rubber, isoprene rubber, silicone rubber, fluororubber or the like.

In addition, an additive or the like may be mixed into the material as appropriate, as long as the surface state of the intermediate transfer body of the embodiment is obtained. The materials listed above are just examples, and thus do not limit the material of the structure of the intermediate transfer body of the embodiment.

(Ink Supplying Unit)

In the ink supplying unit 2 in FIG. 10, an ink image is formed in a way that printing heads 13 supply ink droplets onto the transfer drum 1, whose surface has been processed as described, in response to an image signal transmitted from the control unit.

In FIG. 10, the ink supplying unit 2 includes printing heads 13*a* (yellow), 13*b* (magenta), 13*c* (cyan) and 13*d* (black). In the embodiment, the printing heads 13*a* to 13*d* can be called as the printing heads 13 as a whole. In the ink jet printing apparatus of the embodiment, inks of the colors corresponding to the printing heads 13*a* to 13*d* are supplied respectively from unillustrated ink tanks to the printing heads 13. Heating elements of the printing heads generate heat upon receiving external image signals corresponding to the colors from the control unit, thereby respectively increasing the temperatures of the inks supplied from the corresponding ink tanks to generate bubbles. The generated bubbles are expanded so that ink droplets are ejected from a plurality of ejection ports of each of the printing heads 13. Note that the descriptions given above do not limit the number of ink jet printing heads constituting the ink supplying unit 2, the order of inks to be ejected to the transfer drum 1, and hues of the inks to be used in the embodiment. It is also possible to supply ink droplets for a plurality of times to the same address of the intermediate transfer body by use of the same ink jet head, by slowing the rate at which the intermediate transfer body moves, or relatively moving the ink jet head for a plurality of times over the same pixel on the intermediate transfer body.

The printing heads 13*a* to 13*d* are disposed at certain intervals in the circumferential direction of the transfer drum 1. Although the ink jet printing heads in the structure of FIG. 1 are line-type ones, the type is not limited to this. For instance, it is possible to use printing heads, in which rows each of a plurality of ejection ports are arranged in a certain area in the circumferential or axial direction of the transfer drum 1 (the direction perpendicular to the sheet surface in FIG. 10), the rows corresponding respectively to ink colors (hereinafter, referred to as "conventional serial printing heads"). The ink jet printing head is not limited to one using the above-described heating element, and an ink jet printing head of any type, such as one of the piezoelectric element-type, can be used as long as ink can be ejected from ejection ports of the printing head.

In the embodiment, the following mode is adopted. The plurality of color inks are supplied to the single intermediate transfer body, and then the plurality of color inks supplied to the single intermediate transfer body are transferred to the printing medium. However, it should be noted that the invention is not limited to this mode. For instance, a mode may be adopted in which a plurality of intermediate transfer bodies corresponding respectively to a plurality of color inks of a plurality of colors are used. The color inks supplied to the respective intermediate transfer bodies are transferred individually to a printing medium so that the plurality of color inks are layered on the printing medium.

Note that the ink image formed on the transfer drum 1 needs to be the mirror image of an image to be finally formed on the printing medium 8 in consideration to the fact that the ink image is reversed when being transferred to the printing medium 8. It goes without saying that the image signal, which is supplied to the printing heads 13, has to correspond to the mirror image. For this purpose, the control unit performs mirror-reversion processing (process for obtaining the reversed data) on the image signal transmitted from the image supplying apparatus 110 in order to obtain the image signal corresponding to the mirror image. Thereafter, the image signal is supplied to the printing heads 13.

(Ink)

The ink used in the ink supplying unit 2 is not particularly limited, and any type of general ink jet inks can be used. Specifically, pigment inks, each of which contains at least a pigment as a color agent of the ink, which can be preferably used in the embodiment, are preferably used. This is because pigment inks do not ooze easily in the printing medium compared with dye inks, and because the pigment inks are excellent in water resistance and light resistance. In the embodiment, however, the inks to be used are not limited to pigment inks, and dye inks may be used. Alternatively, even mixed ink mixed a pigment with a dye may be used.

The following inks can be taken as examples of the inks used in the embodiment. In other words, it is possible to obtain inks Y, M, C and K of colors respectively of yellow, magenta, cyan and black, each of which contains a pigment and an anionic compound, as described below.

The applicable types of dye include C. I direct blue 6, 8, 22, 34, 70, 71, 76, 78, 86, 142 and 199; C. I acid blue 9, 22, 40, 59, 93, 102, 104, 117, 120, 167 and 229; C. I direct red 1, 4, 17, 28, 83 and 227; C. I acid red 1, 4, 8, 13, 14, 15, 18, 21, 26, 35, 37, 249, 257, and 289; C. I direct yellow 12, 24, 26, 86, 98, 132 and 142; C. I acid yellow 1, 3, 4, 7 11, 12, 13, 14, 19, 23, 25, 34, 44, 71; C. I food black 1 and 2; C. I acid black 2, 7, 24, 26, 31, 52, 112 and 118.

The applicable pigments of the embodiment include C. I pigment blue 1, 2, 3, 15:3, 16 and 22; C. I pigment red 5, 7, 12, 48 (Ca), 48 (Mn) 57 (Ca), 112 and 122; C. I pigment yellow 1, 2, 3, 13, 16 and 83; carbon black No 2300, 900, 33, 40 and 52; MA 7, 8 and MCF 88 (manufactured by Mitsubishi Chemical Co.); RAVEN 1255 (manufactured by Columbia Co.); REGAL 330R; 660R; MOGUL (produced by Cabot Co.); and Color Black FW1, FW18, S170, S150 and printex 35 (produced by Degussa Co.).

In addition, the mode of ink is not limited. It is possible to use any one of self-dispersion-type, resin-dispersion-type, and microcapsule-type ones.

Water-soluble dispersion resin having a weight average molecular weight of approximately 1,000 to 15,000 is preferably used. Examples of such aqueous dispersion resin includes block copolymers or random copolymers consisting of any of styrene, styrene derivatives, vinylnaphthalene, vinylnaphthalene derivatives, aliphatic alcohol esters of □, β-ethylene unsaturated carboxylic acid, acrylic acid and acrylic acid derivatives, maleic acid, maleic acid derivatives, itaconic acid, itaconic acid derivatives, fumaric acid, and fumaric acid derivatives, and salts of the block copolymers and the random copolymers.

Alternatively, water-soluble resin or a water-soluble crosslinking agent may be also added to improve fastness of an image finally formed. Materials used for water-soluble resin and a water-soluble crosslinking agent are not limited as long as the materials can coexist with components of ink. Preferably used is a method where the above-described dispersion resin or the like is further added a the water-soluble resin. As a water-soluble crosslinking agent, oxazolone or carbodiimide, which have a lower reactivity, is preferably used in terms of stability of ink.

The amount of organic solvent in ink is a factor determining properties of ink such as ejection properties and drying properties. Ink at the time of being transferred to a printing medium consists mainly of only a color material and a high-boiling organic solvent. Hence, the ink composition is optimally designed for the transfer. A high-boiling water-soluble material with a lower vapor pressure is preferably used as an organic solvent. The organic solvents to be used include, for example, polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether, and glycerin. In addition, an alcohol such as ethyl alcohol or isopropyl alcohol can be added to the ink as a component for adjusting viscosity and surface tension of the ink.

The compound ratio of the ink is not limited as well. It is possible to adjust the ratio depending on the ink jet printing system to be selected, the ejecting capability of head, the nozzle diameter or the like, as long as the ink can be ejected. Generally, ink contains dye of 0.1 to 10% of the total amount and a solvent of 5 to 40% thereof and water.

(Amount of Supply of Color Ink)

In the conventional photogravure printing capable of realizing the density gradation, the resolution for general high definition printing is 175 lines of approximately 145 μm per pitch. The maximum level of resolution of the current photogravure printing is 350 lines of approximately 73 μm per pitch. In the case of 1200×1200 dpi (with a normal shooting method of 4.8 pl liquid droplet), the number of droplets at maximum density in supplying above-described inks to these regions by ink jet printing method 46.2 for 145 μm per pitch, and 23.1 for 73 μm per pitch. Further, in the case of 2400×1200 dpi (with a normal shooting method of 2.8 pl liquid droplet), the number is 93.2 for 145 μm per pitch, and 46.6 for 73 μm per pitch.

In the case of 1200×1200 dpi of 145 μm per pitch, 46 color ink droplets saturate each of the ink-attracting portions. For this reason, gradations are achieved by regulating the number of color ink droplets to be shot to each of the color-attracting portions within a range from 0 to 46. In this case, less than about 23 (close to the halved value of 46) color ink droplets shot to an ink-attracting portion do not spread over the ink-attracting portions at the maximum. Meanwhile, in the case where not smaller than 24 (close to the halved value of 46) color ink droplets are shot to an ink-attracting portion, the color ink droplets spread over the ink-attracting portion. For this reason, as described below, the auxiliary liquid is supplied to a pixel to which 0 to 23 ink droplets are shot, and the auxiliary liquid is not supplied to a pixel to which not smaller than 24 ink droplets are shot.

Similarly, in the case of 1200×1200 dpi of 73 μm per pitch, 23 color ink droplets saturate each of the ink-attracting portions. For this reason, gradations are achieved by regulating the number of color ink droplets to be shot to each of the color-attracting portions within a range from 0 to 23. In this case, less than about 12 (close to a value half of 23) color ink droplets shot to an ink-attracting portion may not spread over an ink-attracting portion at the maximum. For this reason, the auxiliary liquid is supplied to a pixel to which 0 to 11 ink droplets are shot, and the auxiliary liquid is not supplied to a pixel to which not smaller than 12 ink droplets are shot.

In addition, in a case where more gradations are necessary, it is possible to realize the gradations by using a method to increase the amount of color ink per pixel. For instance, the amount is increased by halving the densities of the color agents of the above-described color inks, and by setting the doubled frequency is set to each of the ink jet head. The amount can be also increased by halving the rate at which the intermediate transfer body rotates, or by causing the intermediate transfer body to be in contact with a printing medium after the intermediate transfer body is rotated twice. It goes without saying that any of such methods may be combined together to realize the gradations.

(Auxiliary-Liquid-Supplying Unit)

The auxiliary-liquid-supplying unit 3 in FIG. 10 supplies the auxiliary liquid to the intermediate transfer body by use of a printing head 14 including a plurality of ejection ports. The printing head can regulate ejection of the auxiliary liquid based on an auxiliary-liquid-supplying signal generated according to the image signal sent from the control unit. In the ink jet printing apparatus of the embodiment, a line-type ink jet printing head is used as the printing head for supplying the auxiliary liquid. The line-type ink jet printing head uses a heating element (heater) serving as an electric heat conversion element. Although the line-type ink jet printing head is used for the structure of FIG. 10, it is needless to say that a conventional serial-type printing head may be used. Furthermore, the ink jet printing head means is not limited to the embodiment in which the above-described heating element is used. It is also possible to use any type of printing head unit, such as piezoelectric-element-driven-type one, as long as inks can be ejected from ejection ports of the printing heads.

The auxiliary liquid is supplied from an unillustrated auxiliary liquid tank to the printing head 14 for supplying the auxiliary liquid. A heating element of the printing head 14 generates heat upon receiving, from the control unit, the auxiliary-liquid-supplying signal corresponding to an image to be supplied. Hence, the temperature of the auxiliary liquid received from the auxiliary liquid tank is increased to generate bubbles. The generated bubbles are expanded, and the auxiliary liquid is thus ejected from the plurality of ejection portions of the printing head 14.

(Auxiliary Liquid)

In the specification, the auxiliary liquid is a liquid for adjusting the density of the ink to be supplied to each of the ink-attracting portions, and is preferably a transparent liquid. Note that the auxiliary liquid may be colored, as long as the auxiliary liquid does not change the color of the color ink when mixed with the ink.

Specifically, the auxiliary liquid in the embodiment is a liquid which is used to dilute the color ink to lower the density, and which is mixed with the color ink to spread the mixed solution over each of the ink-attracting portions (pixels). In the embodiment, as the auxiliary liquid, preferably used is a transparent ink which mainly consists of components obtained by removing pigments and dye, which are color agent components, from components of the color ink to be used. It is desirable that the components of the auxiliary liquid are similar to those of the color ink since the auxiliary liquid needs to be mixed well with the color ink. Hence, the materials generally used for the auxiliary liquid include resin, solvents, surfactants and additives, which are used for the color ink. The auxiliary liquid is obtained by mixing water with any one of the materials. Colorless fine particles may be further mixed with those components. In addition, the auxiliary liquid is not limited to this. The auxiliary liquid may contain a transfer auxiliary liquid, a liquid imparting anti-friction property, a liquid improving gloss, a liquid deteriorating gloss, or the like.

(Supplying Auxiliary Liquid)

It is necessary to supply the optimum amount of the auxiliary liquid depending on the ink compositions and the spreading properties of the ink-attracting portions on the intermediate transfer body. For instance, the maximum amount of the auxiliary liquid to be used is equal to the halved amount of the above-described maximum amount of the color ink to be supplied to each of the ink-attracting portions. As described, in the case of 1200×1200 dpi of 145 μm per pitch, 46 color ink droplets saturate each of the ink-attracting portions. For this reason, the number of color ink droplets to be shot to each of the color-attracting portions is regulated in a range from 0 to 46 in order to realize gradations. In this case, it is preferable that the auxiliary liquid be supplied to an ink-attracting portion to which 1 to about 23 droplets of the color ink are shot (the value not larger than the halved value of 46 which is the maximum number of ink droplets to be supplied to each of the ink-attracting portions). For instance, in the case of a pixel to which N ($1<N\leqq 2$) ink droplets are shot, the number obtained by subtracting N from 23 is set as the number of droplets of the auxiliary liquid to be supplied to the pixel.

an appropriate amount (number of droplets) of liquid (ink, auxiliary liquid or mixed solution of ink and auxiliary liquid) is supplied to each of the pixels (ink-attracting portions) to achieve the density gradation in the embodiment. In a case where an insufficient amount of liquid is supplied to each of the pixels, the liquid does not spread over (cover) each of the ink-attracting portions. On the other hand, in a case where an excessive amount of the liquid is supplied to each of the pixels, the liquid floods into the adjacent pixels across the ink-repellent portions. Hence, the appropriate amount of the liquid to be supplied to each of the pixels is within a certain range of amount. Within the range, each of the ink-attracting portions is filled with the liquid having landed therein, and the liquid is not beyond the ink-repellent portion surrounding the ink-attracting portions.

In the embodiment, as long as the amount of liquid (ink, auxiliary liquid, or mixed solution of ink and auxiliary liquid) to be supplied is within an appropriate range, the amount may not be uniform for each pixel and for each printing medium. The point of the embodiment is to cause a certain area of liquid (ink, auxiliary liquid or mixed solution of ink and auxiliary liquid) spreading over each of the pixels to be uniform.

In the embodiment, an appropriate amount of liquid varies depending on the wettability of the ink-attracting portions and the repellent characteristics of the ink-repellent portion, the surface tension of ink to be used, and the environment in which the ink-jet printing apparatus is used. However, it suffices that a feasible appropriate amount of the liquid is supplied to each of the pixels. In addition, the appropriate amount of the liquid can be increased or decreased depending on a volume of a droplet of the color ink or the auxiliary liquid, supplying intervals (time-related element) or the like.

Descriptions will be provided below for a method of generating the auxiliary-liquid-supplying signal.

For instance, in a case, where an appropriate amount (number of droplets) of liquid to be supplied to each of the pixels is six to ten, and where ten gradations need to be achieved, the numbers respectively of droplets of the ink and the auxiliary liquid are set for each gradation level as follows in a manner where the total number of droplets is within six to ten. For instance, in a case of a gradation level 1, one droplet of the ink and five droplets of the auxiliary liquid are shot. In the case of a gradation level 2, two droplets of the ink and four droplets of the auxiliary liquid are shot. In the case of a gradation level 3, three droplets of the ink and three droplets of the auxiliary liquid are shot. A table is generated, which is on information on such combinations each between the ink supply amount and the auxiliary-liquid supply amount, which correspond respectively to gradation levels. The table is previously stored in the memory 103.

Upon receiving the external image signal from the image supplying apparatus, the control unit executes the mirror-reversion processing on the signal to obtain the reversed-image signal corresponding to the mirror image. Subsequently, the control unit extracts a gradation necessary to each of the pixels based on the reversed-image signal, and then determines the amounts respectively of the ink and the auxiliary liquid, which are to be supplied, the amounts corresponding to each of the extracted gradations. Thereafter, the control unit generates a signal (data), that is, an auxiliary-liquid-supplying signal (auxiliary-liquid-supplying data) with which the ink and the auxiliary liquid in the respective determined amounts are supplied to each of the pixels.

In the embodiment, a plurality of color inks may be supplied to a single one pixel, and a plurality of liquids may land in a single one landing point in the pixel.

With respect to the supplying method, it is possible to supply the auxiliary liquid to a single one address of the intermediate transfer medium by use of the same ink jet head for a plurality of times, by moving a sheet of paper or the printing head.

(Ink Image Processing Unit)

In FIG. 10, a solution receiver 16 and an air knife 15 are provided in the ink image processing unit 4 to evaporate and remove a solvent of the ink or to separate and remove the solvent of the ink, the solvent mainly consisting of water of the ink. The air knife 15 sends warm air heated by an unillustrated heater. Specifically, the ink image processing unit 4 is provided for the purpose of regulating the transfer properties of the ink image to the printing medium 8. The transfer properties are regulated depending on the volume of the air sent from the air knife 15, and on the volume of heat of the air temperature, with consideration of the difference in permeability of the ink image, which is a coagulated ink image.

In the embodiment, the air knife 15 is used as means for drying the ink image. However, any one, such as an infrared heater, can be used as long as the temperature and the properties of the ink image can be controlled. Conventional means for absorbing a water-containing solution, or conventional means for squeezing a water-containing solution away by use of a squeegee blade roller, may be used as long as the water-containing solution in the ink can be controllably removed.

(Transferring Section)

In FIG. 10, the transferring unit 5 includes the transfer roller 17. The fed-sheet transfer unit 9 includes a transfer rollers 18*a* and 18*b* and transfer guides 19*a* and 19*b*. In the fed-sheet transfer unit 9, the printing medium 8 is transferred by the transfer rollers 18*a* and 18*b* and the transfer guides 19*a* and 19*b*. In the transferring unit 5, the ink image on the transfer drum 1 is then transferred to the transferred printing medium 8 by pressure by the transfer roller 17.

The transfer roller 17 is disposed in a manner where the printing medium 8 passes through the nip portion between the transfer roller 17 and the transfer drum 1. The transfer roller 17 can be constituted of a rubber roller, a metal roller or the like. In the transfer unit 5, it is possible that an unillustrated press control device controls the transfer drum 1 so that the transfer drum can stop pressing against the transfer roller 17. In FIG. 10, the transfer rollers 18*a* and 18*b* rotate in the direction indicated by the arrow B, and the transfer roller 17 rotates in the direction indicated by the arrow C. The transfer roller 17 in the pressed-state rotates following the rotation of the transfer drum 1 with the printing medium interposed in between (following rotation), or is controllably rotated by an unillustrated independent transfer roller driving means. In FIG. 10, the transfer roller 17 rotates following the transfer drum 1.

Meanwhile, in FIG. 10, the printing-medium-separating unit 6 includes a separation claw 20 which is operated according to the transfer timing of the printing medium 8 in the printing-medium-separating unit 6. After the above-described transfer, the separation claw 20 is driven by an unillustrated driving device to separate the printing medium 8 from the transfer drum 1. Thereafter, the printing medium 8 is guided to the discharged-sheet-transferring fixing unit 10 by the transfer guides 21*a* and 21*b*.

(Discharged-Sheet-Transferring Fixing Unit)

In FIG. 10, the discharged-sheet-transferring fixing unit 10 includes the transfer guides 21*a* and 21*b* and the transfer fixing rollers 22*a* and 22*b*. In the discharged-sheet-transferring fixing unit 10, transferring-fixing rollers 22*a* and 22*b* including an infrared heater thermally fix the printing medium 8, which has been transferred by the transfer guides 21*a* and 21*b*, and on which the ink image has been transferred. Thereafter, the printing medium 8 is transferred to an unillustrated discharge tray with the rotation of the rollers. Accordingly, the printing is completed. Fixing rollers conventionally known can be used as the transferring-fixing rollers 22*a* and 22*b*, and the temperature thereof is preferably approximately 30 to 200° C. In addition, the rollers are formed of metal rollers, silicone rubber and the like. In order to improve the releasability of the printing medium 8, silicone oil or the like may be applied to the surface of the transfer fixing rollers 22*a* and 22*b*.

(Cleaning Unit)

In FIG. 10, the cleaning unit 7 further includes a cleaning liquid 23, and a cleaning liquid keeping member 24 which keeps the cleaning liquid 23 therein. The cleaning unit 7 includes a cleaning liquid supplying roller 25*a* and a cleaning roller 25*b* with both of which the cleaning liquid 23 is applied to the transfer drum 1 to remove dust and the like thereon.

In FIG. 10, the cleaning roller 25*b* is driven to rotate following the rotation of the transfer drum 1 (following rotation), or is controllably driven by an unillustrated driving unit. In addition, the cleaning liquid supplying roller 25*a* is driven to rotate with the cleaning roller 25*b*, or is controllably driven by an unillustrated driving unit. As described above, since the cleaning liquid supplying roller 25*a* and the cleaning roller 25*b* are rotated as described, the cleaning liquid 23 is applied to the transfer drum 1. In this manner, the cleaning unit 7 cleans the transfer drum 1. The cleaning unit 7 does not limit the type of the cleaning liquid 23 and the structure of the ink jet printing apparatus, as long as, especially, the surface of the transfer drum 1 can be cleaned. However, the cleaning liquid 23 preferably used is the solution including the surfactant, the water-soluble organic solution and the like, used as the auxiliary liquid.

(Series of Operations)

By referring to FIGS. 10 and 12, detailed descriptions will be provided below for a series of operations of the ink jet printing apparatus of the embodiment having the structure as described above.

Figure 12A:
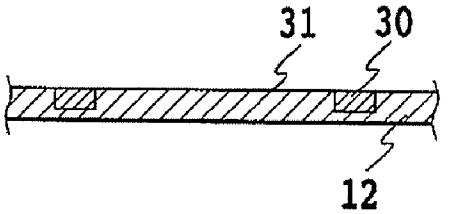
FIGS. 12A to 12E are views for explaining an image forming process of the embodiment of the invention.

Once the ink jet printing apparatus is turned on, the transfer drum 1 starts being driven to rotate. The heaters are then turned on to heat respectively the inside of the transfer drum 1, the air knife 15 and the transfer fixing rollers 22*a* and 22*b* to increase the temperatures thereof respectively to the set temperatures. On the surface layer 12 of the transfer drum 1, the ink-repellent portion 30 and the ink-attracting portions 31 are formed (FIG. 12A).

The image supplying apparatus 110 transmits multi-valued image signals corresponding respectively to the ink colors (KCMY) used in the embodiment (hereinafter, also referred to as "external image signals"). When the multi-valued external image signals are four types of binary signals corresponding respectively to the hues KCMY of the embodiment, the binary signals are directly sent to the printing heads 13. If not, the CPU 101 of the control unit executes the program stored in the memory 103 to convert the multi-valued external signals to the four binary image signals corresponding respectively to the colors YMCK. Thereafter, the CPU 101 performs the mirror-reversion processing on the binary image signals corresponding respectively to the colors YMCK to obtain binary reversed-image signals corresponding respectively to the colors YMCK. Subsequently, the control unit refers the table stored in the memory 103, and obtains the auxiliary-liquid-supplying signal.

Figure 12B:
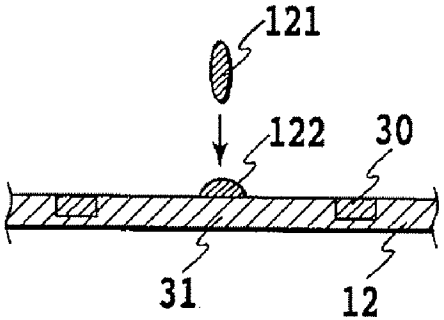

Next, the binary reversed-image signals corresponding respectively to the colors YMCK are transmitted to the respective printing heads 13. With the rotation of the transfer drum 1, the color inks 121 of the corresponding colors YMCK are ejected sequentially respectively from the corresponding printing heads 13*a*, 13*b*, 13*c* and 13*d* to the transfer drum 1, according to the image signals of the respective colors. Specifically, the color inks 121 of the respective colors are supplied to the ink-attracting portions (pixels) 31 on the transfer drum 1, and thus the ink dots 122 are formed (FIG. 12B). It is needless to say that the ink image thus formed is the mirror image of the image to be finally formed on the printing medium 8. There are cases where the inks are not spread over each of the pixels at this stage.

Figure 12C:
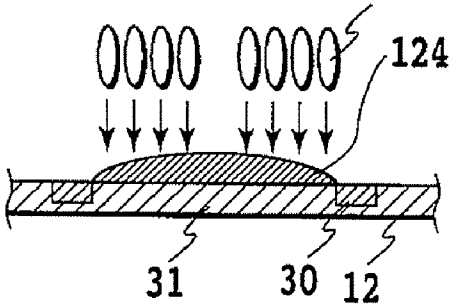

Subsequently, the auxiliary-liquid-supplying signal is transmitted to the auxiliary-liquid-supplying unit 3. With the rotation of the transfer drum 1, the auxiliary liquid 123 is ejected from the printing head 14 for supplying the auxiliary liquid to the transfer drum 1 according to the auxiliary-liquid-supplying signal. Specifically, the auxiliary liquid 123 is supplied to the ink-attracting portions 31 of the transfer drum 1. Specifically, the auxiliary liquid 123 is supplied to the ink-attracting portions of the transfer drum 1, and is mixed with the color inks (ink dots 122) having been landed therein. As a result, the mixed liquid 124 thus obtained spreads over the entirety of each of the ink-attracting portions 31 (FIG. 12C). Here, as for the auxiliary liquid 123, only the number according to a density (gradation) to be printed a pixel is supplied.

Figure 12D:
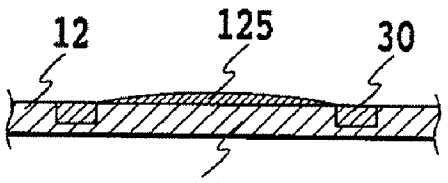

Subsequently, the ink processing unit 4 evaporates and dries the solvent containing water of the ink image formed on the transfer drum 1, thus realizing the ink 125 having conditions optimum to the later-performed transfer of the image (FIG. 12D). Note that this drying (removal of water) step may not be performed.

Figure 12E:
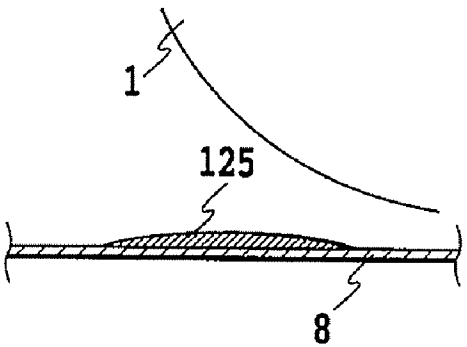

Meanwhile, the printing medium 8 is transferred to the transfer unit 5 by the transfer rollers 18*a* and 18*b* in a way that the printing medium 8 and an edge of the ink image overlap in the nip portion which is a position in which the ink image is transferred to the printing medium, the ink image being formed on the transfer drum 1 as described, and the printing medium 8 serving as a medium to which the ink image is transferred. In the transfer unit 5, an unillustrated sensor detects that an edge of the printing medium 8 reaches the nip portion between the transfer drum 1 and the transfer roller 17. In response to the detection, the transfer roller 18 is driven to press against the transfer drum 1 with the printing medium 8 interposed in between. In this respect, the pressing control apparatus generates a certain transfer pressure and the ink image on the transfer drum 1 is transferred to the printing medium 8 (FIG. 12E).

Thereafter, an unillustrated sensor detects that the edge of the printing medium 8 is discharged from the transfer unit 5. Simultaneously, the separation claw 20 is driven, and is interposed between the transfer drum 1 and the printing medium 8. Hence, the printing medium 8 is separated from the transfer drum 1. Thereafter, the transfer guides 21*a* and 21*b* and the transferring-fixing rollers 22*a* and 22*b* perform fixing processing on the printing medium 8 having been separated from the transfer roller 1 by applying a thermal pressure. The printing medium 8 is then discharged to the discharge tray. After all the inks on the transfer drum 1 are transferred to the printing medium 8, the transfer roller 17 and the separation claw 20 are separated from the printing medium 8.

Subsequently, the cleaning roller 25*b* abuts on the transfer drum 1 to apply the cleaning liquid 23 thereto so that the surface of the transfer drum 1 is cleaned. Once the transfer drum 1 rotates 360°, the cleaning roller 25*b* separates from the transfer drum 1. In a case where the printing continues, the above-described operations are repeated according to the external image signals. In a case where the printing operations are completed and the power is to be turned off, each of the heaters is turned off and the rotation of the transfer drum 1 is stopped, and then the ink jet printing apparatus is turned off. Accordingly, the operations of the apparatus are completed.

In the embodiment, the ink supplying unit 2 is provided at the upstream side of the auxiliary-liquid-supplying unit 3 and the auxiliary liquid is supplied after the inks are supplied. However, the positioning of the units is not limited to this. The auxiliary-liquid-supplying unit 3 may be provided to the upstream side of the ink supplying unit 2 to supply the inks after the auxiliary liquid is supplied.

Second Embodiment

In the first embodiment, an additional step can be effectively carried out. In the step, a reaction liquid is supplied to the surface of an intermediate transfer body, in addition to supplying color inks and an auxiliary liquid are added thereto. By supplying the reaction liquid thereto, the distortion of an ink image can be further reduced more.

The reaction liquid of the embodiment of the invention is a material for reducing the fluidity of ink, in other words, for coagulating color agents contained in ink. Specifically, the reaction liquid is a liquid which plays a role for reducing the fluidity of the ink in contact with the ink, and for preventing the ink having landed on the intermediate transfer body from unnecessarily moving. A case where an image is fixed includes a case where color agents and resin and the like, which composes a compound constituting the ink, chemically react or are absorbed so that the decrease of the fluidity of the entire ink is recognized. In addition, the case where an image is fixed further includes a case where aggregation of solids of the compounds composing the ink locally reduces the fluidity of the ink.

Since the fluidity of the ink is reduced when the reaction liquid and the inks are made in contact with each other as described, the ink having landed on the intermediate transfer body is kept in the landing points. Accordingly, image distortion can be further reduced. In addition, since internal coagulation force of the ink is also enhanced by the coagulation, the rate of transfer of the ink to the printing medium can be further improved. In addition, the solid components in the ink and the reaction liquid become likely to separate from water thereof by coagulation reaction, and thus the water can be easily dried. This makes it possible to improve the transfer rate and drying properties of ink.

By the way, it is necessary to spread the mixed liquid including the ink and the auxiliary liquid over each of the ink-attracting portions serving as pixels to realize the density gradation, as described in the first embodiment. However, when a reaction liquid is supplied to the ink-attracting portions prior to supplying the ink and the auxiliary liquid, color agents of the ink coagulate promptly before the ink and the auxiliary liquid sufficiently spread. As a result, the ink and the auxiliary liquid may not spread over each of the ink-attracting portions.

Besides, in the second embodiment, the reaction liquid is supplied to the intermediate transfer body after the ink and the auxiliary liquid are supplied to the intermediate transfer body. That is, a reaction fluid supplying unit is provided to the downstream side of the ink supplying unit 2 and the auxiliary liquid supplying unit 3. Accordingly, the ink, the auxiliary liquid or the mixed solution thereof can be spread over each of the ink-attracting portions, and then the ink fluidity can be reduced in that state.

It is needless to say that, in the second embodiment, each of the ink-attracting portions needs to have enough size to receive a plurality of the droplets of the ink and the auxiliary liquid in total.

A printing head may be used for the reaction liquid supplying unit as in the case of the ink supplying unit 2 and the auxiliary liquid supplying unit 3. In a case where a printing head is used as the reaction liquid supplying unit, it suffices that a reaction-liquid-supplying signal to supply the reaction liquid may be generated by calculating the logical sum of the reversed image signal and the auxiliary-liquid-supplying signal.

It is necessary to appropriately select a reaction liquid depending on the type of ink to be used to form an image. For instance, a polyelectrolyte is effectively used for dye ink, and metal ions are effectively used for pigment (in which particles are diffused) ink. Furthermore, in a case where metal ions in combination are used for a reaction liquid for the dye ink, a pigment of a color same as the dye is preferably mixed into ink. Alternatively, white particles or transparent particles influencing the color to a small extent may be mixed into the ink.

In the embodiment, a polymer flocculant used as the reaction liquid includes, for instance, cationic polymer flocculant, anionic polymer flocculent, nonionic polymer flocculant or amphoteric polymer flocculent. The metal ions include divalent metal ions such as $Ca^{2+}$, $Cu^{2+}$, $Ni^{2+}$, $Mg^{2+}$ and $Zn^{2+}$ and trivalent metal ions such as $Fe^{3+}$ and $Al^{3+}$. Such ions are desirably introduced as a metal salt solution. The anionic ions of metal salt includes $Cl^-$, $NO^{3-}$, $SO^{4-}$, $I^-$, $Br^-$, $ClO^{3-}$, $RCOO^-$ (R is an alkyl group) or the like. As the reaction liquid, it is possible to use a material whose iconicity is opposite to that of ink to be used. For instance, when the ink is anionic or alkaline, a cationic or acidic material, which has the opposite iconicity to the anionic or alkaline ink, may be used as the reaction liquid.

Other Embodiments

In each of the above-describe embodiments, the auxiliary liquid is supplied to the intermediate transfer body after the ink is supplied thereto, or the inks are supplied to the intermediate transfer body after the auxiliary liquid is supplied thereto. In other words, the inks and the auxiliary liquid are supplied sequentially. However, the supplying is not limited to this. The inks and the auxiliary liquid may be simultaneously supplied.

In this case, for instance, it suffices that the printing heads for supplying inks and the printing head for supplying the auxiliary liquid are disposed so that the ink and the auxiliary liquid are supplied to the surface of the intermediate transfer body in an oblique direction. The disposing makes it possible to simultaneously supplying the ink and the auxiliary liquid to the ink-attracting portions in an ejecting operation.

Alternatively, a printing head capable of simultaneously supplying inks and an auxiliary liquid may be used. In this case, it suffices that the amounts of the ink and the auxiliary liquid are regulated when the printing head operates to eject the ink and the auxiliary liquid according to image data and auxiliary-liquid supplying data to supply the ink and the auxiliary liquid.

Example 1

(a) Preparation of Intermediate Transfer Body

A base member was used which was obtained by coating an aluminum plate having a thickness of 0.5 mm with hydrophilic urethane resin to the thickness of 0.5 mm. Plasma processing, in which a fluorine gas was used, was performed on the base member by use of a mask. The mask had a 145 μm pitch and lines, which form apertures, and each of which has a 20 μm width. Accordingly, square ink-attracting portions, each of which has 125 μm on a side, were uniformly formed on the surface of the aluminum plate. The ink-attracting portions are surrounded by an ink-repellent portion having a width of 20 μm, (patterning method schematically shown in FIG. 5).

Plasma Processing Conditions

| | |
|---|---|
| Used gas | CF4 |
| Gas flow rate | 80 sccm |
| Pressure | 8 Pa |
| RF power | 150 w |

The obtained intermediate transfer body, which includes the ink-repellent portion and the ink-attracting portions, was wound around an intermediate transfer roll, and then the intermediate transfer roll with the intermediate transfer body was mounted on an ink jet printing apparatus. In this example, the method was presented in which the transfer medium is used in a way that the transfer medium was wound around the intermediate transfer roll for experimental convenience. However, it is also possible to directly coat the surface of the intermediate transfer roll with rubber. Alternatively, a rubber roll may be used for directly patterning the ink-repellent portions on the transfer medium.

(b) Image Formation

The following color ink and the auxiliary liquid were ejected from an ink jet printing unit (nozzle density of 1200 dpi, ejection volume of 4.8 pl and driving frequency of 5 kHz) to form an inverted a monochrome photo image. The monochrome image was multi-gradation image having multiple color gradations ranging from light to deep. In addition, the amounts of the ink to be supplied respectively to the pixels were made different from one another depending on the gradations (densities). However, the amount of the auxiliary liquid to be supplied was adjusted so that the total amount of the ink and the auxiliary liquid could be equivalent to 45 droplets in each pixel. Accordingly, a mixed liquid of the color ink and the auxiliary liquid spread over each of the pixels to which the ink and the auxiliary liquid were supplied. Thus, the pixels had equal areas, over each of which the mixed liquid spread regardless of the amounts of the supplied color ink.

[Composition of Color Ink]

The composition of the color ink was as follows.

| | |
|---|---|
| CI. food black 2 (dye) | 3 parts |
| Diethylene glycol (solvent) | 10 parts |
| Ion-exchanged water | 86.5 parts |
| Acetylenol EH (surfactant) | 0.5 parts |

[Composition of Auxiliary Liquid]

The composition of the auxiliary liquid was as follows.

| | |
|---|---|
| Diethylene glycol (solvent) | 10 parts |
| Ion exchanged water | 86.5 parts |
| Acetylenol EH (surfactant) | 0.5 parts |

[Contact Angle]

The contact angle of the color ink with the ink-repellent portion on the intermediate transfer body and the contact angle of the color ink with each of the ink-attracting portions thereon were as follows.

| | |
|---|---|
| Ink-repellent portion | 86.6° |
| Ink-attracting portion | 40.3° |

The contact angle of the auxiliary liquid with the ink-repellent portion on the intermediate transfer body and the contact angle of the auxiliary liquid with each of the ink-attracting portions thereon were as follows.

| | |
|---|---|
| Ink-repellent portion | 92.5° |
| Ink-attracting portion | 38.7° |

(C) Transfer

The intermediate transfer body on which an image was formed was made in contact with a printing medium (New NPI high quality paper: Ream weight 90, manufactured by Nippon Paper Co.) to transfer the image on the intermediate transfer body to the printing medium. Accordingly, a photo image with smooth gradations of ranging from light to deep was obtained on the printing medium.

Comparative Example 1

An image was formed as in the case of the example 1, except that the auxiliary liquid was not used. In other words, the image was formed by use of only the ink without the auxiliary liquid. In a case where a smaller amount of ink was supplied to an ink-attracting portion, the ink did not spread over the ink-attracting portion. Accordingly, graininess was apparent in a light color portion in the obtained image transferred to a printing medium, compared to the image of Example 1.

Example 2

(a) Preparation of Intermediate Transfer Body

A base member was used which was obtained by coating an PET film having a thickness of 0.2 mm with silicone rubber (KE 30, manufactured by Shin-Etsu Chemical Co., Ltd.) which has a rubber hardness of 60°, to a thickness of 0.2 mm. Square ink-attracting portions were uniformly formed on the base member by using an atmospheric pressure plasma processing equipment (AP-T02, manufactured by Sekisui Chemical Co.) with a mask with a 145 μm pitch and an aperture width of 120 μm. Each of the ink-attracting portions has 120 μm on a side, and the ink-attracting portions were surrounded by an ink-repellent portion having a line width of 25 μm (patterning method schematically shown in FIG. 7).

[Plasma Processing Conditions]

| | |
|---|---|
| Irradiation distance | 2 mm |
| Input Voltage | 240 V |
| Frequency | 10 kHz |
| Introduced gas | 02/N2 (3:97) |
| Processing Time | 30 sec |

Four intermediate transfer bodies obtained in this way were prepared. The intermediate transfer bodies were wound around an intermediate transfer roll so that the intermediate transfer bodies could correspond to respective color ink jet heads, then the intermediate transfer roll with the intermediate transfer bodies was mounted on an ink jet printing apparatus.

(b) Image Formation

The color inks and an auxiliary liquid were ejected from an ink jet printing unit (nozzle density of 1200 dpi, ejection volume of 4.8 pl and driving frequency of 120 kHz), and an inverted color photo image was formed.

As in the case of the first example, the amount of the auxiliary liquid to be supplied to each pixel was adjusted so that the total liquid amount was equivalent to 45 liquid droplets in each pixel. Accordingly, the mixed liquid of the ink of each color and the auxiliary liquid spread over the corresponding pixel to which the color ink and the auxiliary liquid were supplied. Thus, the pixels had equal areas, over each of which the mixed liquid spread regardless of the amounts of the supplied color inks.

[Composition of Color Inks]

The composition of the color inks were as follows.

| | | |
|---|---|---|
| Each of the following pigments | | 3 parts |
| Black | Carbon Black (MCF88, manufactured by Mitsubishi Chemical Co.) | |
| Cyan | Pigment Blue 15 | |
| Magenta | Pigment Red 7 | |
| Yellow | Pigment Yellow 74 | |
| Styrene-acrylic acid-acrylic acid-ethyl acrylate copolymer (Acid value of 240, weight average molecular weight of 5,000) | | 1 part |
| Glycerine | | 10 parts |
| Ethylene glycol | | 5 parts |
| Surfactant (Acetylenol EH, manufactured by Kawaken Fine Chemicals Co., Ltd.) | | 1 part |
| Ion-exchanged water | | 80 parts |

[Composition of Auxiliary Liquid]

The composition of the auxiliary liquid was as follows.

| | |
|---|---|
| Styrene-acrylic acid-acrylic acid-ethyl acrylate copolymer (Acid value of 240, weight average molecular weight of 5,000) | 1 part |
| Glycerine | 10 parts |
| Ethylene glycol | 5 parts |
| Surfactant (Acetylenol EH, manufactured by Kawaken Fine Chemicals Co., Ltd.) | 1 part |
| Ion-exchanged water | 83 parts |

[Contact Angle]

The contact angle of each of the color inks with the ink-repellent portion on the intermediate transfer body and the contact angle of each of the color inks with each of the ink-attracting portions thereon were as follows.

| | |
|---|---|
| Ink-repellent portion | 73.6° to 84.4° |
| Ink-attracting portion | not larger than 15° |

The contact angle of the auxiliary liquid with the ink-repellent portion on the intermediate transfer body and the contact angle of the auxiliary liquid with each of the ink-attracting portions thereon were as follows.

| | |
|---|---|
| Ink-repellent portion | 87.2° |
| Ink-attracting portion | not larger than 15° |

(C) Transfer

First, an air sending device sent air to the surface of the printing image on the intermediate transfer body, the device being disposed between the ink jet printing unit and a pressure roller. Thereafter, the pressure roller caused the intermediate transfer body and a surface coated print-paper sheet having less ink absorbency (NPI coat paper of A-size and ream weight of 40.5 kg high, manufactured by Nippon Paper Co.) to be in contact with each other. Thus, the image on the intermediate transfer body was transferred to the printing medium. Thereby, a smooth photo image on the printing medium with various gradations of colors including light to deep colors was obtained.

Comparative Example 2

An image was formed as in the case of the example 2, except that an intermediate transfer body including ink-attracting portions and an ink-repellent portion was not used. In other words, the image was formed in a state where no pattern consisting of the ink-repellent portion and ink-attracting portions was formed on the intermediate transfer body (the entire surface served as an ink-repellent portion). Droplets of inks supplied to adjacent portions on the intermediate transfer body were attracted to each other, and thus the point the points in which the inks land fluctuated. As a result, no high quality image was formed.

Comparative Example 3

An image was formed as in the case of the example 2, except that the plasma irradiation was performed on the entire surface of the intermediate transfer body of the example 2 (the entire surface served as an ink-attracting portion) in the preparation of the intermediate transfer body. In other words, the image was formed by use of the intermediate transfer body with the entire surface on which plasma irradiation image was performed. The inks on the intermediate transfer body spread over the surface thereof, and were mixed. Hence, no image was formed.

Example 3

(a) Preparation of Intermediate Transfer Body

An intermediate transfer body was formed as in the case of example 2. In example 3, a configuration of the single intermediate transfer body was formed so as to receive all of four color inks and an auxiliary liquid.

(b) Image Formation

The color inks used in the example 2 and the following auxiliary liquid were ejected from an ink jet printing unit (nozzle density of 1200 dpi, ejection volume of 4.8 pl and driving frequency of 5 kHz) onto a single intermediate transfer body. Thereafter, a reaction liquid was ejected from the ink jet printing unit, and an inverted color photo image was formed on the single intermediate transfer body. Accordingly, the mixed liquid of the any one of the color inks, the auxiliary liquid and the reaction liquid spread over a pixel on the ink-attracting portion of the corresponding color to which the color ink and the auxiliary liquid and the reaction liquid were supplied. The auxiliary liquid was used to adjust the amounts of the inks and the auxiliary liquid to be supplied respectively to the pixels, so that 50 droplets of the auxiliary liquid and each the color inks could be supplied to each pixel at minimum, and 100 droplets of the auxiliary liquid and any one of the color inks are supplied to each pixel at maximum. In addition, seven droplets of the following reaction liquid were added to each pixel.

[Composition of Auxiliary Liquid]

The composition of the auxiliary liquid was as follows.

| | |
|---|---|
| Fine particle silica (average particle diameter of 90 nm) | 3 parts |
| Styrene-acrylic acid-acrylic acid-ethyl acrylate copolymer (Acid value of 240, weight average molecular weight of 5,000) | 1 part |
| Glycerine | 10 parts |
| Ethylene glycol | 5 parts |
| Surfactant (Acetylenol EH, manufactured by Kawaken Fine Chemicals Co., Ltd.) | 1 part |
| Ion-exchanged water | 80 parts |

[Composition of Reaction Liquid]

The composition of the reaction liquid was as follows.

| | |
|---|---|
| Calcium chloride dihydrate | 10 parts |
| Styrene-acrylic acid-acrylic acid-ethyl acrylate copolymer (Acid value of 240, weight average molecular weight of 5,000) | 1 part |
| Glycerine | 10 parts |
| Ethylene glycol | 5 parts |
| Surfactant (Acetylenol EH, manufactured by Kawaken Fine Chemicals) | 1 part |
| Ion-exchanged water | 73 parts |

[Contact Angle]

The contact angle of each of the color inks with the ink-repellent portion on the intermediate transfer body and the contact angle of each of the color inks with each of the ink-attracting portions thereon were as follows.

| | |
|---|---|
| Ink-repellent portion | 73.6° to 84.4° |
| Ink-attracting portion | not larger than 15° |

The contact angle of the auxiliary liquid with the ink-repellent portion on the intermediate transfer body and the contact angle of the auxiliary liquid with each of the ink-attracting portions thereon were as follows.

| | |
|---|---|
| Ink-repellent portion | 84.0° |
| Ink-attracting portion | not larger than 15° |

The contact angle of the reaction liquid with the ink-repellent portion on the intermediate transfer body and the contact angle of the reaction liquid with the ink-attracting portions thereon are as follows.

| | |
|---|---|
| Ink-repellent portion | 85.5° |
| Ink-attracting portion | not larger than 15° |

(C) Transfer

First, an air sending device sent air to the surface of the printing image on the intermediate transfer body, the device being disposed between the ink jet printing unit and the pressure roller. Thereafter, the pressure roller caused the intermediate transfer body and a surface coated print-paper sheet (NPI coat paper of A-size, a ream weight of 40.5 kg, manufactured by Nippon Paper Co.) to be in contact with each other. Thus, the image on the intermediate transfer body was transferred to the printing medium. Thereby, a smooth photo image with smooth gradations ranging from light to deep was obtained on the printing medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-375949, filed Dec. 27, 2005, which is hereby incorporated by reference herein its entirety.

What is claimed is:

1. An ink jet printing method comprising the steps of:

supplying ink and a transparent liquid to ink-attracting regions of an intermediate transfer body, the respective ink-attracting regions being surrounded by an ink-repellent region; and transferring an ink image to a printing medium, the ink image being formed by the supplied ink and the supplied liquid, wherein each of the plurality of the ink-attracting regions has an area in which a plurality of droplets of the ink and the liquid in total can be received, and each of the ink-repellent regions has a greater contact angle with the ink and the liquid than each of the ink-attracting regions.

2. The ink jet printing method as recited in claim 1, wherein each of the ink-attracting regions includes a plurality of points, in each of which at least one of the ink and the liquid lands.

3. The ink jet printing method as recited in claim 1, further comprising a step of determining the amounts of the liquid to be supplied to the ink-attracting regions, based on the amounts of the ink to be supplied to the ink-attracting regions.

4. The ink jet printing method as recited in claim 1, wherein the ink-attracting regions correspond respectively to pixels, and the ink jet printing method further comprises the step of determining the amounts of the liquid and the amounts of the ink, which are supplied to the pixels, based on the gradation levels of the pixels.

5. The ink jet printing method as recited in claim 1, further comprising a step of supplying a material, which coagulates the ink, to the ink-attracting regions supplied with the ink and the liquid, between the supplying step and the transferring step, wherein each of the plurality of the ink-attracting regions has an area in which a plurality of droplets of the ink, the liquid and the material in total can be received.

6. An ink jet printing method comprising the steps of:

supplying ink and a liquid to ink-attracting regions of an intermediate transfer body, the respective ink-attracting regions being surrounded by an ink-repellent region, the liquid used for spreading the ink supplied to the ink-attracting regions over the entire regions of the corresponding ink-attracting regions; and transferring an ink image to a printing medium, the ink image being formed by the supplied ink and the supplied liquid, wherein each of the plurality of the ink-attracting regions has an area in which a plurality of droplets of the ink and the liquid in total can be received, and each of the ink-repellent regions has a greater contact angle with the ink and the liquid than each of the ink-attracting regions.

7. The ink jet printing method as recited in claim 6, further comprising a step of supplying a material, which coagulates the ink, to the ink-attracting regions supplied with the ink and the liquid, between the supplying step and the transferring step, wherein each of the plurality of the ink-attracting regions has an area in which a plurality of droplets of the ink, the liquid and the material in total can be received.

8. An ink jet printing apparatus comprising:

an intermediate transfer body including a plurality of ink-attracting regions, the respective ink-attracting regions being surrounded by an ink-repellent region;

an ink supply unit that supplies ink to the ink-attracting regions of the intermediate transfer body;

a liquid supply unit that supplies a transparent liquid to the ink-attracting regions of the intermediate transfer body; and a transfer unit that transfers an ink image to a printing medium, the ink image being formed by the supplied ink and the supplied transparent liquid, wherein each of the plurality of the ink-attracting regions has an area in which a plurality of droplets of the ink and the liquid in total can be received, and each of the ink-repellent regions has a greater contact angle with the ink and the liquid than each of the ink-attracting regions.

9. An ink jet printing apparatus comprising:

an intermediate transfer body including a plurality of ink-attracting regions, the respective ink-attracting regions being surrounded by an ink-repellent region;

an ink supply unit that supplies ink to the ink-attracting regions of the intermediate transfer body;

a liquid supply unit that supplies a liquid to the ink-attracting regions of the intermediate transfer body, the liquid used for spreading the ink to be supplied to the ink-attracting regions over the entire regions of the ink-attracting regions; and a transfer unit that transfers an ink image to a printing medium, the ink image being formed by the supplied ink and the supplied liquid, wherein each of the plurality of the ink-attracting regions has an area in which a plurality of droplets of the ink and the liquid in total can be received, and each of the ink-repellent regions has a greater contact angle with the ink and the liquid than each of the ink-attracting regions.

* * * * *